United States Patent [19]

Hasegawa et al.

[11] 4,248,072

[45] Feb. 3, 1981

[54] METHOD OF AND APPARATUS FOR PRODUCING PLATE MATERIAL HAVING UNIFORM WIDTH AND LENGTHWISE THICKNESS VARIATION

[75] Inventors: Yoshimichi Hasegawa, Nagoya; Osamu Furuta, Tokai, both of Japan

[73] Assignee: Aichi Steel Works, Limited, Japan

[21] Appl. No.: 58,892

[22] Filed: Jul. 19, 1979

[30] Foreign Application Priority Data

| | | | |
|---|---|---|---|
| Jul. 25, 1978 | [JP] | Japan | 53/90805 |
| Oct. 13, 1978 | [JP] | Japan | 53/126320 |
| Nov. 2, 1978 | [JP] | Japan | 53/135503 |
| Nov. 4, 1978 | [JP] | Japan | 53/136047 |
| Nov. 18, 1978 | [JP] | Japan | 53/142653 |
| Dec. 23, 1978 | [JP] | Japan | 53/161368 |

[51] Int. Cl.[3] ..... B21B 37/14; B21B 37/00

[52] U.S. Cl. ..... 72/8; 72/11; 72/17; 72/240

[58] Field of Search ..... 72/6–8, 72/11, 17, 240, 203

[56] References Cited

U.S. PATENT DOCUMENTS

| | | | |
|---|---|---|---|
| 3,417,592 | 12/1968 | Fielding | 72/199 |
| 3,820,373 | 6/1974 | Shiguma et al. | 72/185 |

FOREIGN PATENT DOCUMENTS

| | | | |
|---|---|---|---|
| 596308 | 3/1978 | U.S.S.R. | 72/240 |

*Primary Examiner*—Milton S. Mehr
*Attorney, Agent, or Firm*—Karl W. Flocks

[57] ABSTRACT

A method of producing a plate material having a uniform width and a lengthwise thickness variation by imparting plastic deformations to a work by means of widthwise rolling rolls and thicknesswise rolling rolls. The method has the steps of measuring the travelling amounts of the work at the outlet sides of the widthwise rolling rolls and the thicknesswise rolling rolls, continuously changing the roll gap of the widthwise rolling rolls in accordance with the measured travelling amount and a predetermined condition so as to reduce the width of the work at portions of the latter where the width is expected to be increased as a result of the subsequent thicknesswise rolling so that the work after the thicknesswise rolling may have a uniform width, and changing the thickness of the work by continuously changing the roll gap in the thicknesswise rolling rolls in accordance with the measured travelling amount and a predetermined condition. Also, disclosed is an apparatus for carrying out this method.

21 Claims, 24 Drawing Figures

METHOD OF AND APPARATUS FOR PRODUCING PLATE MATERIAL HAVING UNIFORM WIDTH AND LENGTHWISE THICKNESS VARIATION

BACKGROUND OF THE INVENTION

The present invention relates to a method of producing a plate material having a uniform width and a thickness which varies along the length thereof, as well as to an apparatus suitable for carrying out the method.

The plate material having a uniform width and a thickness gradually varying along the length thereof can be used quite reasonably as a structural member which is subjected to bending moment gradually varying in the longitudinal direction of the material. The use of such a plate material offers various advantages such as the reduction of weight, save of material, simplification of construction and so forth. It is considered, therefore, that there will be an enormous demand for such plate materials, if such materials are commercially available comparatively easily.

This kind of plate material will provide remarkable advantages, particularly when it is used as the material of a leaf spring of a suspension of automobile, such as reduction of weight, save of material, simplification of construction, smoothening of the shock-absorbing characteristic and so on. However, there has been proposed heretofore no method nor apparatus for massproducing such plate materials economically.

Needless to say, there has been proposed to produce a plate material having a thickness which varies along the length of the material, by controlling the roll gap between rolls by which the plate is rolled, as shown, for example, in Japanese Patent Laid-open Publication No. 16660/1974 published on Feb. 14, 1974 and the specification of U.S. Pat. No. 3,820,373 Specification. In these prior arts, however, no consideration is made as to the lateral spreading of the plate material which is caused as a result of the thicknesswise rolling of the material. It is, therefore, necessary to take the final step of trimming in which both the side edges of the rolled material are trimmed to provide a uniform width of the final product. The material removed from the plate member during the trimming is wasted. Thus, the conventional method is not preferred also from the economical point of view.

SUMMARY OF THE INVENTION

It is therefore an object of the invention to provide a method of and apparatus for producing a plate material having a uniform width and a thickness which varies along the length of the plate material, capable of overcoming above described problems of the prior art.

To this end, according to the invention, widthwise rolls for effecting a rolling in the widthwise direction and thicknesswise rolls for effecting a rolling in the thicknesswise direction are combined such that the material is at first subjected to the widthwise rolling to reduce the width at the portion thereof which is expected to be laterally spread by the subsequent thicknesswise rolling and then the roll gap of the thicknesswise rolling rolls is continuously changed in accordance with previously given dimensions of product and rolling condition. By so doing, the desired plate material having uniform width and thickness varying along the length can be obtained in one step, without necessitating the final trimming step.

It is another object of the invention to provide a method of and apparatus for improving the dimensional accuracy or precision of the plate material having a uniform width and a thickness which varies along the length thereof.

To this end, according to the invention, a plate-shape function (width function, thickness function) representing the changes in plate width and plate thickness in relation to the plate length is determined in accordance with the predetermined shape of the product. A correction for eliminating the dimensional error which will be caused by the deflection of rolls which changes corresponding to the change in the rolling reduction (i.e. draft) and/or a correction for eliminating the dimensional error which will be caused by a change in the position at which the roll surface leaves the rolled material, the change being caused by the change in the slope or gradient of the material surface are effected on the plate-shape function to provide a roll-gap control function. The rolling work is conducted while controlling the roll gap in accordance with thus obtained roll-gap control function so as to improve the dimensional accuracy or precision of the plate material having varying thickness.

Also, according to another aspect of the invention, the apparatus of the invention employs a roll deflection compensation device. The deflection of roll is preestimated by a calculation which employes at least one linear function approximating the relation between the roll reduction or draft and the roll deflection. The rolling is conducted while compensating the deflection of the roll in accordance with the sum of the predetermined roll gap value and the preestimated value of roll deflection to the roll deflection compensation device, thereby to improve the dimensional accuracy or precision of the plate material having varying thickness.

Further, according to still another aspect of the invention, a highly precise control is performed by a controller which includes a calculating means for pretreatment adapted to perform beforehand a calculation taking into account the influence of at least one of the roll diameter and the roll deflection, small-sized calculating means for control of width and thickness adapted to promptly calculate the instant command values of roll gaps in accordance with the function given by the pretreating calculation means, and a servo means adapted to control the roll adjusting mechanism. This also contributes to the improvement in the dimensional accuracy of the plate material.

According to a further aspect of the invention, in order to produce a plate material having a uniform width and a varying thickness at a high dimensional precision, the rolls gaps of the width-wise rolling rolls and thicknesswise rolling rolls are controlled in relation to the travelling amount of the work. The control of the roll gaps in the widthwise and thicknesswise rolling rolls are made by changing the roll positions such that the center or bisector of each roll gaps is not deviated from respective reference line, e.g. neutral line of the work, so as to ensure a high dimensional precision.

It is still another object of the invention to provide a method of and apparatus for producing plate members having varying thickness by precisely cutting or shearing a continuous blank having a plurality of lengthwise thickness variations into separate plate members at a high precision.

According to a still further aspect of the invention, the shearing of the blank material into separate plate members is performed in a manner described below.

Namely, according to the invention, the controller of the rolling mill generates an electric signal representing a portion to be shorn, simultaneously with the completion of deformation of the portion to be shown which deformation is effected by the thicknesswise rolls. A shearing device located at the downstream side of the rolling mill as viewed in the direction of movement of the half-finished material is actuated in accordance with the above-mentioned signal generated by the controller, so as to shear the half-finished material into separate plate members during the movement or travel of the work.

Alternatively, marks are applied on the half-finished portions of the latter to be shorn, in accordance with the above-mentioned electric signal, and the half-finished material is shorn later into separate plate materials having the predetermined unit length at a high precision.

The features and advantages of the invention will become clear from the following description of the preferred embodiments taken in conjunction with the accompanying drawings.

DESCRIPTION OF THE PREFERRED EMBODIMENTS

Hereinafter, a description will be made as to the method of the invention for producing a plate material having a uniform width and lengthwise variation of thickness, with reference to a tapered leaf spring for automobile suspension, by way of example.

According to the method of the invention, a thickness function which defines the plate thickness in relation to the longitudinal position on the tapered leaf, as well as the initial value of the plate thickness (usually, the thickness at the thinnest part of the tapered leaf) are determined in accordance with the shape of the tapered leaf to be obtained. Subsequently, the increase of the plate width which is expected to be caused by a rolling in accordance with the thickness function, as well as the width increase caused by the thicknesswise rolling are determined by calculation, for a given blank material, i.e. the work 1 before the processing. Then, an increment of width of the material which is expected to be caused by the reduction in accordance with above-mentioned thickness function and the width increment during the thicknesswise rolling are calculated. Subsequently, the shape of an intermediate material (the work 1 after a widthwise rolling) is determined, taking these width increments into account, such that the work after the subsequent thicknesswise rolling has a uniform width over its entire length. More specifically, a width function representing the relation between the plate width and the lengthwise position on the intermediate material immediately before the thicknesswise rolling, as well as the initial value of the plate width (usually, plate width at the narrowest part) is obtained.

Figure 1:
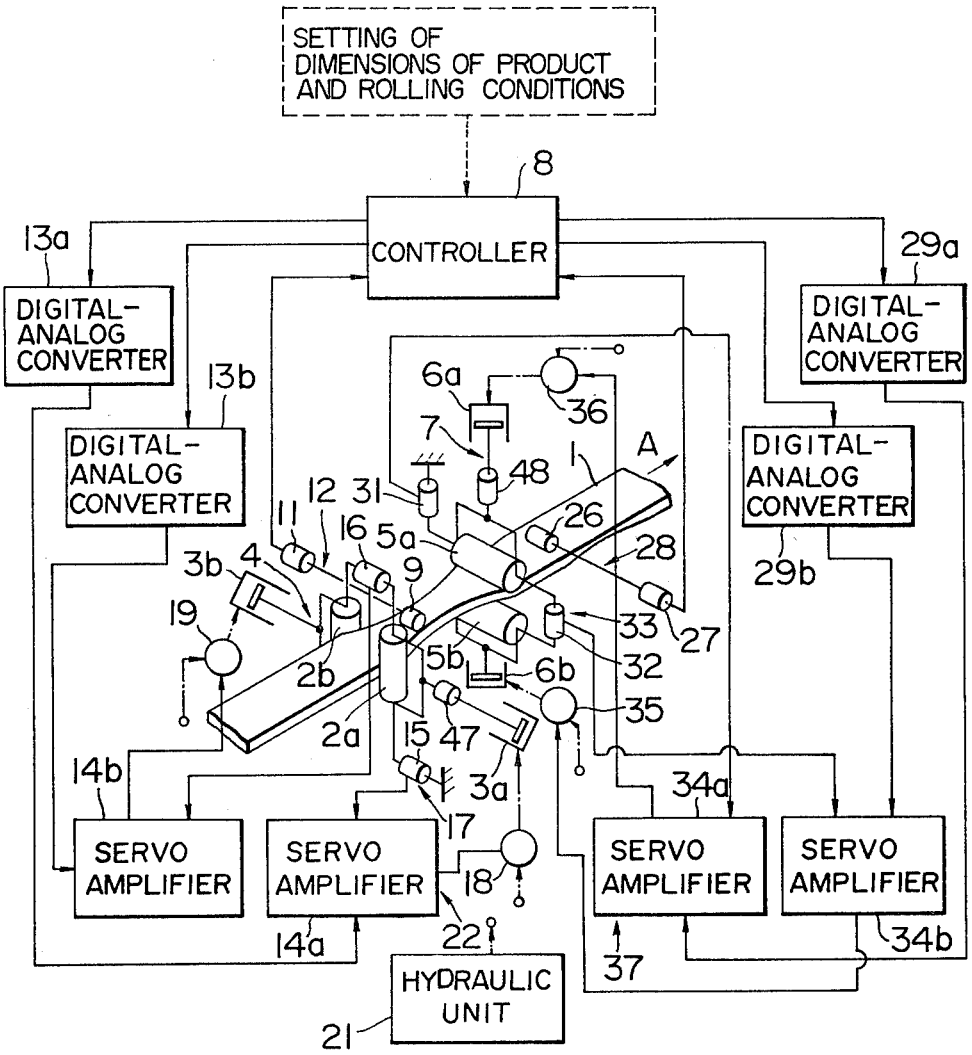
FIG. 1 is a schematic illustration of an apparatus for producing a plate material having a uniform width and varying thickness, constructed in accordance with a first embodiment of the invention.

The preparation for rolling is completed as the thickness function, thickness initial value, width function and the width initial value are set in a controller 8 as shown in FIG. 1.

It is considered that, in some cases, the plate width or thickness is considerably large as compared with the width initial value or the thickness initial value, so that the work 1 cannot be smoothly introduced to the widthwise rolling rolls 2*a*, 2*b* or thicknesswise rolling roll 5*a*, 5b when the roll gap is set in accordance with the initial value from the beginning of the rolling. In such a case, the roll gap is set at a value larger than the calculated initial value and, after the work 1 has been introduced into the rolls, the roll gap is promptly reduced to the initial value, by the aid of load cells 47, 48 (See FIGS. 3 and 4) attached to a roll adjusting mechanism 4, 7.

When the preparation for the rolling is over, the work 1 is fed into the gap between the widthwise rolling rolls 2a, 2b. This is detected by the load cell 47. After the lapse of a predetermined time from the delivery of the signal by the load cell, a measuring roller 9 of a travelling amount measuring device 12 is brought to the operating position. Since at this time the leading end of the work 1 has passed the travelling amount measuring device 12, the measuring roller 9 is gently put into contact with the upper surface of the work 1 in the direction perpendicular to the latter.

An encoder 11 commences to generate pulses as the work 1 is contacted by the measuring roller 9. These pulses are delivered to the controller 8. Upon receipt of these pulses, the controller calculates the command position of the widthwise rolling rolls 2a, 2b, i.e. the command roll gap, in accordance with these pulses and the width function and the width initial value which has been beforehand set in the controller 8. Then, the adjustment of position of the widthwise rolling rolls 2a, 2b, i.e. the adjustment of the roll gap of the widthwise rolling roll, is commenced in accordance with the result of the calculation. Since the roll gap adjustment is commenced after the measuring roller has contacted the work 1, the leading portion of the work between the widthwise rolling rolls 2a, 2b and the measuring roller 9 cannot be processed and, hence, has to be wasted. For this reason, the measuring roller 9 is preferably positioned as close as possible to the widthwise rolling rolls 2a, 2b.

Figure 4:
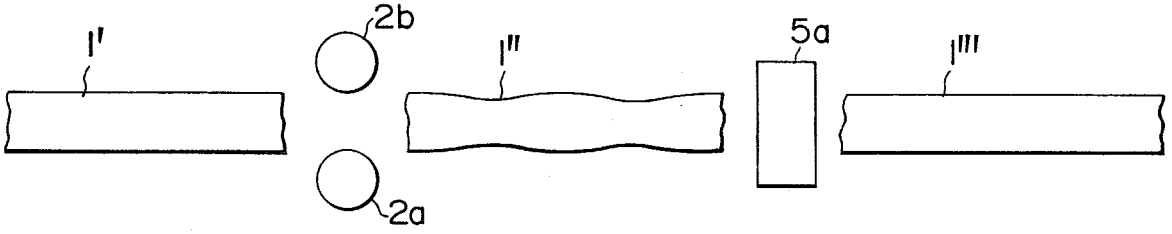
FIGS. 4 and 5 are plan views and front elevational views of a work, showing how the shape of the work is changed as it is processed by the apparatus shown in FIG. 1.
Figure 5:
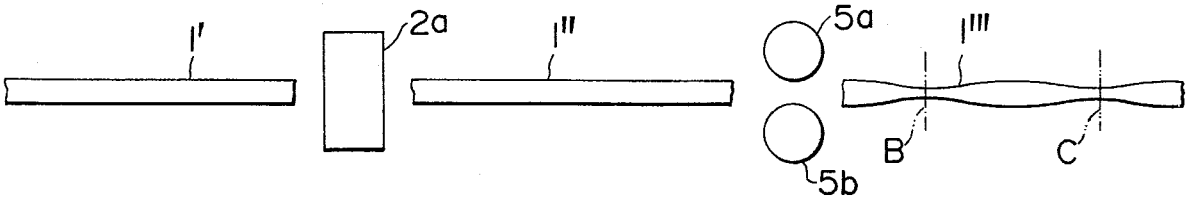

After the position adjustment, i.e. the roll gap adjustment, is commenced by the controller 8, the widthwise rolling rolls 2a, 2b are cyclically moved toward and away from each other. Therefore, the black material 1' having uniform width and thickness as shown at left ends of FIGS. 4 and 5 is changed as it passes the widthwise rolling rolls 2a, 2b into an intermediate material 1'' which has, as shown at mid part of FIG. 4, a periodical lengthwise width reduction. Although the material thickness is increased at portions of reduced width, this increment is rather small and negligible. Namely, the effect of the width reduction appears mostly as the elongation in the longitudinal direction of the blank material 1'.

The introduction of the leading end of the intermediate material 1'' into the thicknesswise rolling rolls 5a, 5b is detected by the load cell 48. After lapse of a predetermined time from the delivery of a signal from the load cell 48, a travelling amount measuring device 28 is brought into operating position by means of a pneumatic cylinder 43. As a result, a measuring roller 26 of the device 28 is put into contact with the leading end of the work 1 (half-finished material 1'''), and an encoder 27 starts to deliver pulses.

The adjustment of roll position of the thicknesswise rolling rolls 5a, 5b (this will be referred to as "thickness adjustment, hereinafter) in accordance with the thickness function is commenced at an instant at which the travelling amount of the intermediate member 1'' after the start of the adjustment of widthwise rolling rolls 2a, 2b (this will be referred to as width adjustment, hereinafter) as measured by the travelling amount measuring device 12 has reached a value corresponding to the distance between the axes of the widthwise and thicknesswise rolling rolls 2a, 2b and 5a, 5b. Thereafter, the thicknesswise rolling rolls 5a, 5b are periodically moved toward and away from each other in accordance with the instruction given by the controller 8, so that the intermediate material 1'' is shaped into a half-finished product 1''' having a lengthwise thickness variation as shown at right end part of FIG. 5. The reduction of thickness naturally causes an increment of the width. However, since the intermediate member 1'' has been shaped to have regular width reduction in anticipation of the width increment, the half-finished product 1''' can have a uniform width over its entire length, as shown at right end part of FIG. 4.

A piece of tapered leaf as the final product is obtained by shearing the half-finished product 1''' along the two-dot-and-dash line B, C shown at right end part of FIG. 5.

According to the invention, the tapered leaf is produced substantially in the manner described above. However, since the width adjustment and the thickness adjustment are made separately, it is considered that the point on the work at which the width adjustment is started and the point at which the thickness adjustment is started may be offset from each other by the error in lengthwise measurement. Such an offset will grow large as the adjusting cycles are repeated, due to the accumulation of the error to deteriorate the uniformity of the width of half-finished product 1'''. It is therefore preferred to forcibly make the starting point of finishing point of the width adjustment cycle and thickness adjustment cycle coincide with each other at each adjusting cycle.

Figure 8:
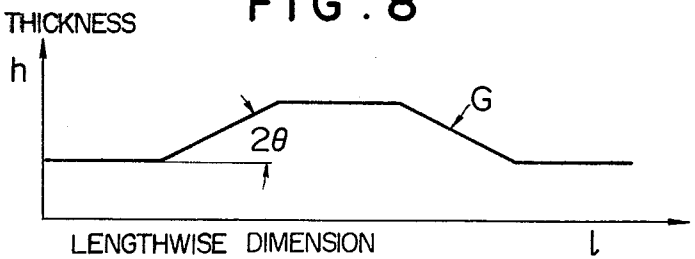
FIG. 8 is a drawing for explaining the plate shape function of the plate material as shown in FIG. 7.
Figure 7:
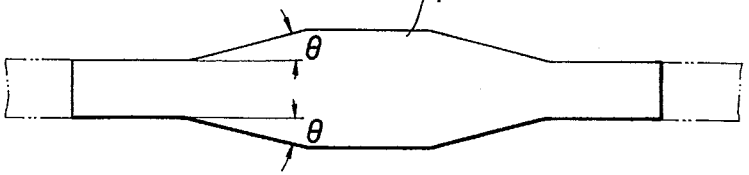
FIG. 7 is a front elevational view of an example of a plate material having varying thickness as produced in accordance with the method of the invention.

An example of data as obtained when the rolling is made while forcibly correcting the lengthwise offset of the thickness adjustment and the width adjustment at each adjusting cycle is as follows:

| | |
|---|---|
| blank material: | 20.5 mm thick, 100.5 mm wide, 8900 mm long, AISI 5155 (i.e. 55Cr3) spring steel |
| rolling temperature: | 900° C. |
| maximum rolling force: | 21 tons (withwise)<br>228 tons (thicknesswise) |
| size of product: | a tapered leaf having width of 100 mm as shown in FIG. 8) |
| tolerance of product: | ±0.07 mm or less (thickness)<br>±0.02 mm or less (width) |

From above data, it will be understood how the invention is suitable for use in the production of a material having uniform width and lengthwise thickness variation, e.g. a tapered leaf.

Hereinafter, an embodiment of the apparatus of the invention for producing a plate material having a uniform width and lengthwise thickness variation will be described with reference to the drawings.

Referring first to FIG. 1, a work 1 to be processed is adapted to be move in the direction of arrow A. A pair of widthwise rolling rolls 2a, 2b are disposed at the upstream side end of the flow of the work 1. These widthwise rolling rolls 2a, 2b are rotatably carried by a frame (not shown), for free adjustment of the roll position. The roll position of these rolls 2a, 2b is adjusted by means of a roll adjusting mechanism 4 which includes hydraulic cylinders 3a, 3b.

A pair of thicknesswise rolling rolls 5*a*, 5*b* are disposed at the downstream side of the widthwise rolling rolls 2*a*, 2*b* and are carried rotatably by the frame. The positions of these rolls 5*a*, 5*b* are adjustable, as in the case of the widthwise rolling rolls, by means of a roll adjusting mechanism 7 including hydraulic cylinders 6*a*, 6*b*. The positions of widthwise and thicknesswise rolling rolls 2*a*, 2*b* and 5*a*, 5*b* are adapted to be controlled in accordance with the instructions given by the controller 8, in which the initial values of the width and thickness as determined by the shape of the product, as well as width and thickness functions which are determined from the width and breadth in relation to the length of the product, are set beforehand. Thus, the controller 8 produces electric signals representing the command positions of the widthwise and thicknesswise rolling rolls 2*a*, 2*b* and 5*a*, 5*b* in relation to the travelling amount of the work 1, in accordance with the set dimensions of product and rolling conditions.

This operation will be described below with reference to the case of the widthwise rolling rolls 2*a*, 2*b*, by way of example.

The amount of travel of the work 1 is detected by means of a travelling amount measuring device 12 which has a measuring roller 9 adapted to rotate in contact with the work 1, and an encoder 11 adapted to deliver a pulse for each unit angular movement of the roller 9. The pulses thus produced are delivered to the controller 8. The controller 8 calculates the command roll positions in relation to the length of the work 1, from the pulses received and the previously set width function and the width initial value, and delivers the result of calculation as the output.

The digital output from the controller 8 is converted into an analog signal by means of digital to analog converters (referred to as D/A converters, hereinafter) 13*a*, 13*b*, and is delivered to servo amplifiers 14*a*, 14*b*. The servo amplifiers 14*a*, 14*b* receive the output from differential transformers of transducers 15 and 16. The differential transformer of transducer 15 is adapted to measure the distance between the frame and the axis of the roll 2*a*, while the differential transformer 16 is adapted to measure the distance between axes of the rolls 2*a*, 2*b*. These differential transformers in combination constitute a roller position sensing device 17, capable of measuring not only the distance between the axes of two rolls 2*a*, 2*b* relatively to each other but also the absolute axis positions of these rolls, so that the rolls are positioned always in symmetry with each other with respect to the widthwise bisector line of the work during the rolling. Servo valves 18, 19 receive outputs corresponding to the differences between these inputs from the differential transformers 15, 16 and the inputs from the D/A converters 13*a*, 13*b*. In consequence, the servo valves 18, 19 are started to allow a hydraulic unit 21 to deliver pressurized oil to the hydraulic cylinders 3*a*, 3*b* thereby to change and adjsut the positions of the widthwise rolling rolls 2*a*, 2*b*. As a result of this adjustment, the inputs coming from the differential transformers 15, 16 come to coincide with the input from the D/A converters 13*a*, 13*b*. Then, the servo valves 18, 19 are stationed and the widthwise rolling rolls 2*a*, 2*b* are set to the positions instructed by the controller 8. Thus, the servo amplifiers 14*a*, 14*b* and the servo valves 18, 19 in combination constitute a controlling means 22 which controls the operation of the roll adjusting mechanism 4 in accordance with the instruction given by the controller 8 and the output from the roller position sensing device 17.

Although the description has been made specifically to the adjustment of positions of the widthwise rolling rolls 2*a*, 2*b*, the thicknesswise rolling rollers 5*a*, 5*b* are adjusted in the same way. Namely, the travelling amount of the work 1 is detected by the travelling amount measuring device 28 having a measuring roller 26 and an encoder 27, and is delivered to the controller 8. The controller 8 then calculate the command positions of the thicknesswise rolling rolls from the delivered travelling amount, and from the function representing the relation between the travelling amount and the thickness, i.e. the thickness function, and the initial value of the thickness which are beforehand stored in the controller 8.

The result of the calculation is then converted into analog signal by means of D/A converters 29*a*, 29*b*. The control means 37 controls the roll adjusting mechanism 7 including hydraulic cylinders 6*a*, 6*b* in accordance with the output from the roller position sensing device 38 constituted by differential transformers 31, 32 and the analog signals delivered by the D/A converters 29*a*, 29*b*. The differential transformer 31 is adapted to measure the distance between the frame and the axis of the roll 5*a*, while the differential transformer 32 is adapted to measure the distance between the axes of the rolls 5*a* and 5*b*. As a result, the positions of the thickness rolling rolls 5*a*, 5*b* are controlled in accordance with the instruction given by the controller 8.

Figure 2:
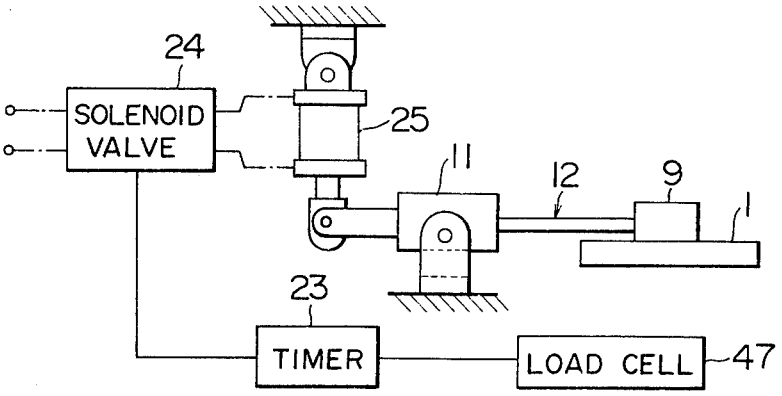
FIGS. 2 and 3 show the detail of a travelling amount measuring device incorporated in the apparatus shown in FIG. 1.
Figure 3:
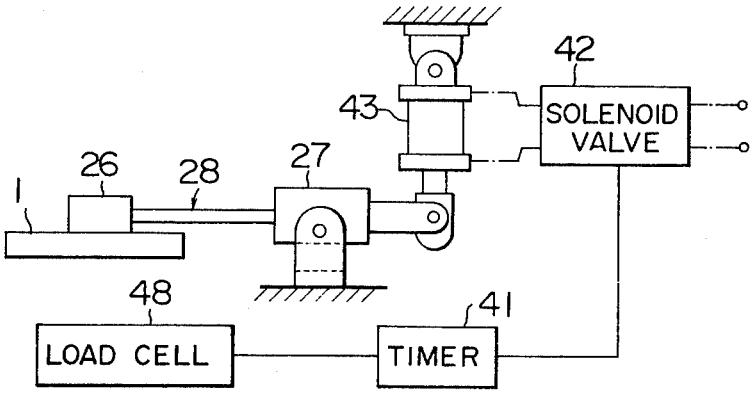
Figure 6:
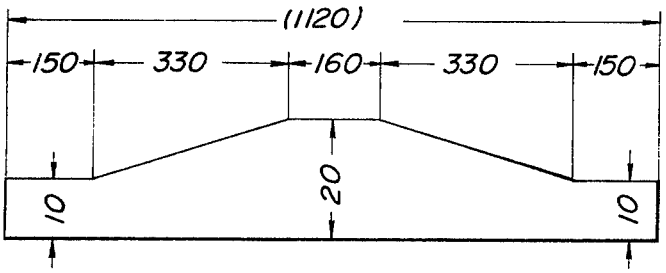
FIG. 6 shows an example of the dimension of a plate material having varying thickness as produced by the apparatus shown in FIG. 1.

The aforementioned roll adjusting mechanisms 4, 7 are provided with load cells 47, 48 for detecting the introduction of the work 1 into the widthwise and thicknesswise rolling rolls 2*a*, 2*b* and 5*a*, 5*b*, respectively. As shown in FIGS. 2 and 3, the outputs from these load cells are delivered to solenoid valves 24, 42 via timers 23, 41. These solenoid valves 24, 42 are adapted for controlling the operation of the pneumatic cylinders 25, 43 for moving the aforementioned travelling amount measuring devices 12, 18 into and out of the contact with the work 1. The arrangement is such that the travelling amount measuring devices 12, 28 are moved to the operating positions, respectively, after lapse of predetermined times from the detection of introduction of the leading end of the work 1 into respective rolls made by the load cells 47, 48, i.e. after the leading end of the work 1 has passed respective positions of detection of the travelling amount of the work 1.

It is to be noted that, in the described embodiment withwise rolling rolls 2*a*, 2*b* and the thicknesswise rolling rolls 5*a*, 5*b* are carried independently for free adjustment of axis positions irrespective of the other roll. In addition each pair of rolls 2*a*, 2*b* (5*a*, 5*b*) has two differential transformers 15, 16 (31, 32) so that not only the distance between the axes of two rolls 2*a*, 2*b* (5*a*, 5*b*) but also the absolute positions of the roll axes can be measured. It is therefore possible to move two rolls 2*a*, 2*b* (5*a*, 5*b*) of each pair if symmetry with each other with respect to the neutral axis of the work 1. Therefore, no undesirable warp of the work is caused even if the work is fed at a constant height.

For simplifying the construction of the apparatus, it is possible to fix the position of one of the two rolls of each pair. In such a case, the roll gap can be adjusted by moving only one of the rolls 2*a*, 2*b* or 5*a*, 5*b*, so that the roll adjusting mechanism including the hydraulic cylinder, control mechanism including servo valve and servo amplifier and the D/A converter can be eliminated for one of the rolls 2a, 2b (5a, 5b) of each pair. Also, since only the distance between the two axes is measured, each pair of rolls 2a, 2b (5a, 5b) is required to be associated with only one transformer.

As means for measuring the roll positions, various other measuring devices such as those adapted to measure the roll positions indirectly through the measurement of the positions of pistons of the hydraulic cylinders 3a, 3b (6a, 6b) can be used.

Also, non-contact type sensors such as image sensor can be used as means for measuring the travelling amount of the work.

Further, other constituents of the described embodiment can be substituted by various other devices without departing from the scope of the invention.

In the described embodiment, the calculation of the rolling length and the command roll positions are made digitally while the control of the roll adjusting mechanism is made by way of analog. Alternatively, it is possible to perform the calculation of the rolling length and the command roll positions by way of analog. It is also possible to make the control of the roll adjusting mechanism digitally.

Although the invention is intended for use mainly in hot rolling, it is possible to apply the invention to a cold rolling for some degree of roll reduction. Also, the invention is applicable to a multi-stage rolling mill in which one or both of the widthwise and thcknesswise rolling rolls have a plurality of roll stands.

As will be clearly seen from the above explanation, the present invention offers the following advantages.

(1) It is possible to produce plate materials having a uniform width and lengthwise thickness variation at a low cost, without necessitating the additional step of trimming.

(2) The invention permits the rationalization of the shape of tapered leaf or the like products, reduction of weight and improvement of the yield of material.

In addition, the following advantages are brought about by the apparatus of the invention.

(3) It is possible to easily set the plate width and the lengthwise change of plate thickness, and to change the plate thickness and width which have been set beforehand.

(4) Since the roll positions are adjusted upon detect of the actual travel distance of the work, it is possible to obtain correct shape of the product.

Figure 24:
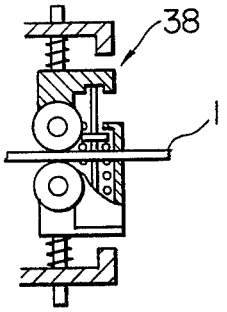
FIG. 24 is a schematic illustration of a section measuring device.

The dimensional precision of the product will be further improved by addition of a section size measuring device 38 as shown in FIG. 24 to the described apparatus of the invention.

The section size measuring device 38 is disposed outside the thicknesswise rolling rolls 5, and includes two pairs of opposing idle rollers adapted to pinch the work after the thicknesswise rolling in both of vertical and lateral directions. Only the rollers for vertical pinching are shown in FIG. 24. These idle rollers are adapted to measure the width and thickness of the rolled product which is being moved continuously. The measuring outputs are delivered to the controller 8 shown in FIG. 1.

The controller 8 has a function to correct the initial set value in accordance with the actually measured values, and is adapted to deliver the result of the correction to respective servo amplifiers as electric output signals.

In operation, at the initial stage of the rolling, the desired size of the designated product is set in the controller 8, without taking into consideration the material of the work M, rolling temperature, rigidity of the roller dies and other factors, and a rolling is made with these set values. Then, the size of the resultant work (product) is measured and fed back to the controller 8, by means of the section size measuring device 38 so as to correct the initial set value. By correcting the initial set value in the described manner, it is possible to obtain the desired precision of size of the product irrespective of the material of the work and characteristic of the production apparatus.

Also, in this case, it is possible to set as the initial set value the value incorporating the estimated values of characteristics of the material of work and the production apparatus and to correct only the dimensional error between the estimated value and the actually measured value in accordance with the result of the measurement made by the section size measuring device 38. Needless to say, by so doing, it is possible to obtain a higher precision of the dimension of the work.

Hereinafter, a description will be made as to another embodiment in which, in order to produce at a higher dimensional precision the plate material having a uniform thickness and lengthwise thickness variation, the rolling is conducted eliminating the error attributable to the deflections of widthwise rolling rolls 2a, 2b and thicknesswise rolling rolls 5a, 5b and/or the error attributable to the change in position at which the work leaves the rolls. In this embodiment, a roll gap controlling function is obtained by effecting a correction for eliminating above-mentioned errors on the plate shape function representing the desired shape of the plate material to be obtained, in advance to the rolling operation, and the rolling is conducted in accordance with thus obtained roll gap controlling function.

The roll gap controlling function of this embodiment is obtained by correcting the shape function of the tapered leaf material, for eliminating both of the error attributable to the roll deflection and the error attributable to the change in position at which the roll leaves the work surface.

A description will be made first as to the roll deflection.

Generally, as well known to those skilled in the following increment of thickness $\Delta h$ as given by the following equation (1) is caused by an increase $\Delta S$ of the roll gap due to an eccentricity of the rolling rolls or the like reason.

$$\Delta h = \frac{K}{K + M} \Delta S \qquad (1)$$

Figure 10:
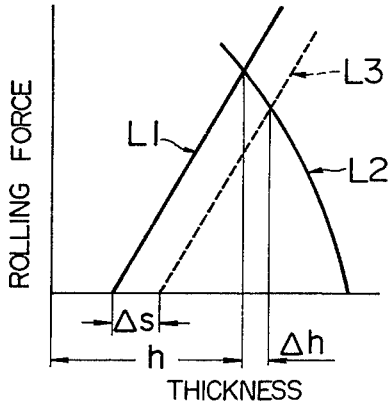

In the equation (1) above, K represents the rigidity coefficient of the rolling mill, i.e. the gradient of the resiliency characteristic curve L1. Of the rolling mill shown in FIG. 10, the curve L1 usually being a straight line, while M represents the plasticity coefficient of the work, i.e. the gradient of a line tangent to the plasticity characteristic curve L2 of the work as shown in FIG. 10. As will be seen from FIG. 10, no substantial increase of the plate thickness h is caused by the increment of the roll gap $\Delta S$, but a slight increment $\Delta h$ is caused which amounts to the distance between the starting point and the point at which the work plasticity characteristic curve L2 is intersected by the curve L3 which is obtained by shifting translationally the resiliency characteristic curve L1 by a distance ΔS.

It is to be noted, however, the equation (1) is valid only when the roll gap is changed slightly due to eccentricity of the rolls or the like reason. In case of a rolling of the tapered leaf T, the roll gap is intentionally changed largely. In this case, therefore, the change in the plate thickness after the rolling is determined in accordance with the following equation (2), as the sum of the thickness change $\Delta h_1$ which is established for each of a plurality of small sections of the range over which the roll gap is changed, the thickness change of each section being given by $$\Delta h_1 = \frac{K_1}{K_1 + M_1} \Delta S_1 \qquad (2)$$

$$\Sigma \Delta h_1 = \Sigma \frac{K_1}{K_1 + M_1} \Delta S_1$$

Therefore, the thickness error attributable to the resilient deformation of the rolling mill, when the roll gap is changed by ΣΔSi intentionally, is given by the following equation (3).

$$\Sigma \Delta S_1 - \Sigma \Delta h_1 = \Sigma \frac{M_1}{K_1 + M_1} \Delta S_1 \qquad (3)$$

The equation (3), however, represents the thickness error attributable to the resilient deformation of the whole rolling mill. In case that the rolling mill is controlled to obtain a coincidence between the command roll gap given by the controller 8 and the roll gap as measured by a measuring device interposed between the axes of rolls 5*a*, 5*b* while fixing the axis of one 5*b* of the rolls, the thickness error attributable to the resilient deformation of the frame is automatically eliminated. Thus, only the error attributable to the roll deflection is to be corrected. Usually, the roll deflection amounts to 50 to 70% of the deflection of the whole rolling mill.

Thus, it is regarded that the apparent rigidity K1 of the rolling mill has been increased to $\alpha K_1 (\alpha > 1)$, and the amount to be compensated is given by the following equation.

$$\Sigma \frac{M_1}{aK_1 + M_1} \Delta S_1$$

Figure 11:
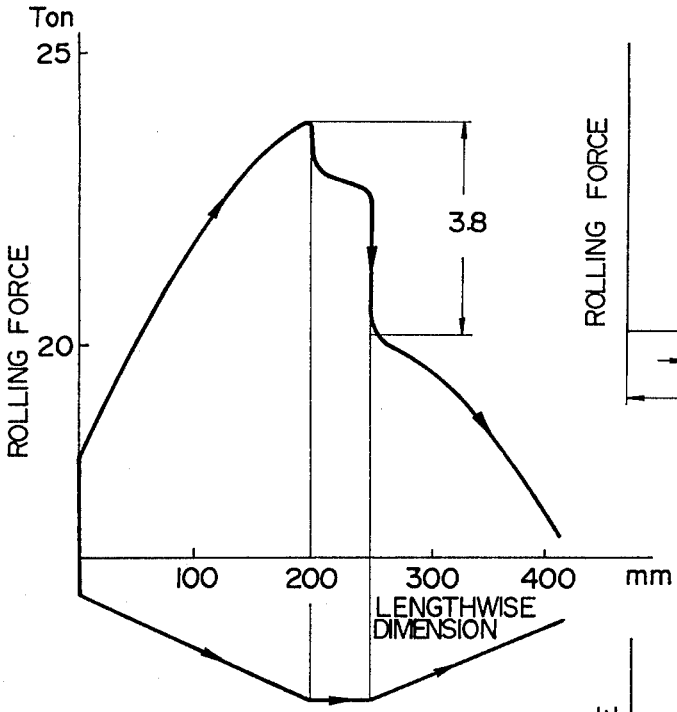
FIGS. 10, 11 and 12 are illustrations for explaining the correction of shape function for eliminating the dimentional error attributable to the deflection of roll.
Figure 12:
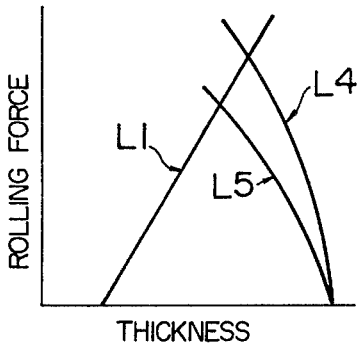

Further, according to the experiments made by the present inventors, it has been confirmed that different rolling reduction powers are exerted when the rolling gap is being decreased, i.e. when the rolling reduction is being increased, and when the roll gap is being increased, as shown in FIG. 11. In this case, the gradient or slope of increase and decrease of the rolling reduction were 1/100. Namely, even when the factors such as material, rolling temperature and so forth are equal, a phenomenon is observed that the plasticity characteristic of the work as observed when the roll gap is being decreased and that as observed when the roll gap is being increased are materially different from each other, as shown by curves L4 and L5 in FIG. 12.

Therefore, in this embodiment, the correction of compensation is made, when the roll gap is being decreased and when the roll gap is being increased, respectively, in accordance with the following equations:

$$\Sigma \frac{M_{11}}{aK_1 + M_{11}} \Delta S_1$$

and $$\Sigma \frac{M_{21}}{aK_1 + M_{21}} \Delta S_1$$

Hereinafter, an explanation will be made as to the correction of the dimensional error attributable to the change in the position at which the plate surface leaves the roll.

As stated before, the gradient of the surface of the tapered leaf T is extremely small. Conventionally, as in the case of the rolling of strip or the like, the roll gap between two rolls has been controlled in accordance with the shape function of the tapered leaf T itself, on an assumption that the roll outlet point is always located in the plane including both of axes of the upper and the lower rolls. However, as a matter of fact, the position of the roll outlet point is changed depending on whether the rolling is effected on the tapered portion or a straight flat portion, resulting in a thickness error in the tapered portion of the leaf.

Figure 13:
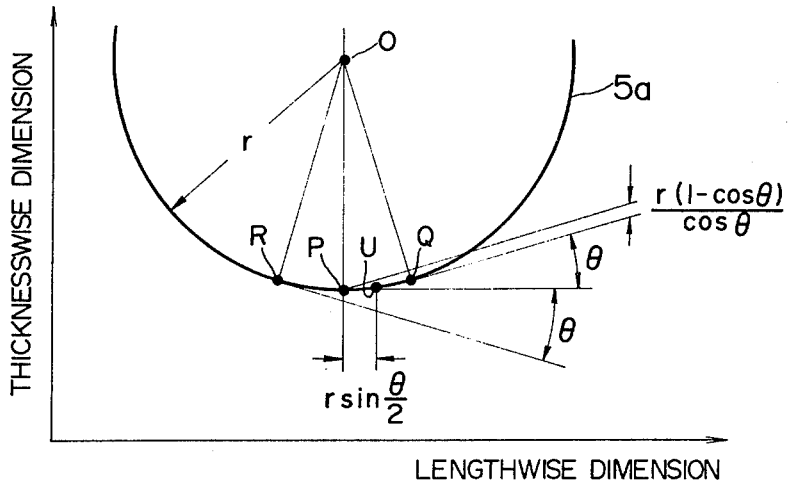
FIG. 13 is an illustration for explaining the correction of the shape function for eliminating the dimensional error attributable to the change in position at which the product leaves the roll surface.

More specifically, referring to FIG. 13, the roll outlet point, i.e. the point at which the roll leaves the work surface, is positioned at P, when the rolling is effected on a flat portion where there is no taper. This outlet point, however, is shifted to a position Q, when the rolling is effected on a portion having a positive gradient, i.e. a portion of the work in which the roll gap is gradually increased as the work moves, and to a position R when the rolling is effected on the portion having a negative gradient. As a result, the plate thickness is reduced at the tapered portion of the work, by an amount which is twice as large as the value given by $r(1-\cos\theta)/\cos\theta$, because the same thckness reduction is caused at both sides of the work. In the equation above, r represents the radius of the roll 5*a*, while $\theta$ represents the gradient of the surface of the tapered leaf. This reduction of thickness amounts to 0.125 mm when a tapered leaf material T having a taper of $\tan\theta = 5/100$ is used by means of a roll of a roll radius of 200 mm. Thus, this reduction of thickness takes a value which approaches the tolerance of ±0.15 mm which is usually required in the production of the tapered leaf material for automobile auspension.

Figure 9:
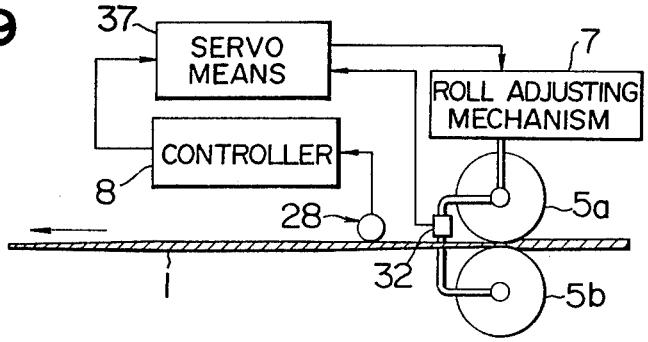
FIG. 9 is a drawing for schematically showing an apparatus for producing a plate material having a uniform width and varying thickness.

In order to obtain the thickness of the tapered leaf material well meeting the command value, it is necessary to effect a control such that the increment of the roll gap between the rolls 5*a*, 5*b* is commenced at a point P which is offset from the point U at which the taper starts toward the horizontal or parallel portion of the work by a distance $\theta/2$, as will be seen from FIG. 13. In the described embodiment, the above stated correction is effected on the roll gap controlling function. The roll gap controlling function on which the correction or compensation for eliminating the error attributable to the widthwise and thicknesswise rolls 2*a*, 2*b* and 5*a*, 5*b* and also the error attributable the change of the roll outlet point have been effected is then set in the controller 8 of FIG. 9.

With this roll gap controlling function, it is possible to obtain the higher precision of the tapered leaf T, by the same rolling operation as the conventional rolling method. Namely, the controller 8 calculates the command control gap in accordance with the output from the travelling amount measuring device 28 disposed at the downstream side of the rolls 5*a*, 5*b* and the previously set roll gap controlling function, and the servo means 37 controls the roll adjusting mechanism 7 such that the reading of the roll gap measuring device (differential transformer 32 coincides with the command roll gap, so that the errors attributable to the roll deflection and the change in the roll outlet point are eliminated to ensure a higher precision of the tapered leaf.

For an easier understanding of the invention, the description has been made with specific reference to a rolling of the tapered leaf material which has a parallel portion of the uniform thickness and a tapered portion in which the thickness varies linearly. Needless to say, however, the invention can equally be applied to the rolling of ordinary plate material in which the plate thickness changes along a curve.

It is not always necessary to effect the correction for removing both of the error attributable to the change in the roll deflection and change in the roll outlet point. Namely, it is still effective to effect a correction for eliminating either one of these errors, or to apply such correction of error or errors only to the thicknesswise rolling rolls.

As has been described, according to the invention, it becomes possible to produce plate materials having lengthwise thickness variation at a higher precision than the prior art, without substantial rise of installation cost.

Hereinafter, a description will be made as to how the compensation for the error attributable to the change in the roll deflection is made, with reference to the drawings.

Figure 14:
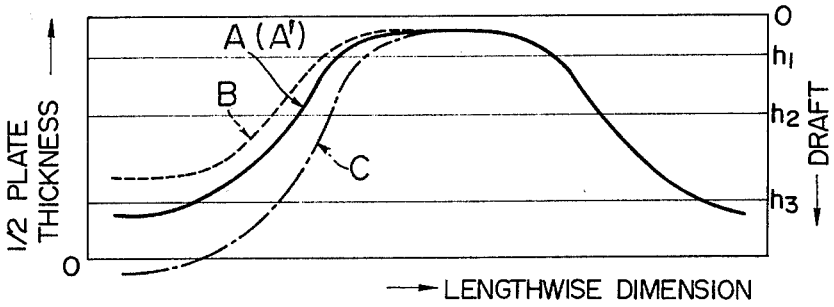
FIG. 14 shows a product curve (curve A), draft instruction curve (curve A′), product shape curve (curve B) which is to be obtained when the draft is obtained in accordance with the curve A′ and a final draft instruction curve (curve C) which is obtained when the correction is made to eliminate the dimensional error attributable to the roll deflection, for explaining the method of the invention for improving the precision of the plate material having varying thickness.

The plate material having a lengthwise thickness variation is an elongated member in which a plurality of sections each having a profile as shown by a curve A in FIG. 14 are continuously connected. Although each longitudinal section of the material has a sectional shape which is symmetry with respect to the thicknesswise bisector line, the description will be made hereinunder only with respect to the upper half part of the material, for the simplification of the explanation. Therefore, the rolling reduction and the compensation amount are considered only for one of the rolls. Also, it is to be noted that the axis of ordinate has been stretched as compared with axis of abscissa, in the chart shown in FIG. 14.

In FIG. 14, the curve A' which has the same shape as the curve A is the rolling reduction instruction curve, the axis of ordinate of which is shown at the rightside of the graph. When the rolling reduction is controlled in accordance with this rolling reduction instruction, the resultant product will have a shape as shown by the curve B. Usually, this curve B offset from the curve A in the upward direction, due to the influence of the roll deflection, so as to exhibit a state of insufficient rolling reduction. Therefore, for obtaining the desired final shape as shown by the curve A, it is necessary to make the rolling reduction control in accordance with a curve C (final rolling reduction instruction curve) which is obtained by effecting a correction of reduction attributable to the roll deflection on the instruction curve A'.

As will be understood from the following description, according to the invention, the rolling reduction which makes the roll gap coincide with the command roll gap is obtained experimentarily by actually actuating the roll adjusting mechanism, and effecting the roll gap control by the controller in accordance with thus obtained rolling reduction.

Figure 15:
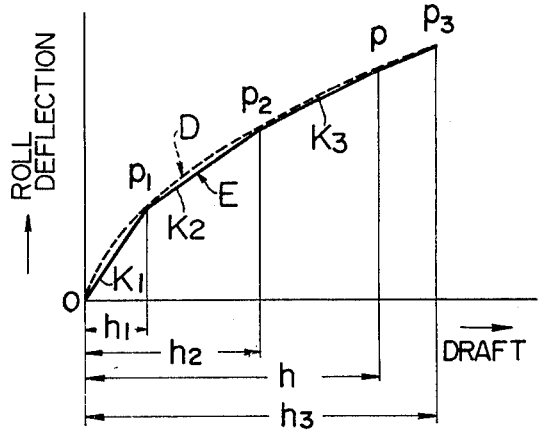
FIG. 15 is an illustration explanatory of the method of determining an approximating value for any desired roll deflection.

Referring to FIG. 15, a broken line curve D shows how the roll deflection is changed in relation to the change in the rolling reduction. This characteristic curve D is applicable only to a specific rolling mill for rolling a plate material having a specific lengthwise thickness variation. Thus, a different curve is applied when the factors such as material of the work, rolling temperature, plate width, plate thickness, roll diameter, roll span and so forth are changed. This curve usually exhibits a large gradient for a small rolling reducition and a small gradient for a large rolling reduction.

The rolling reduction or draft as represented by the axis of abscissa is divided into a suitable number of sections as shown in FIG. 15. Three values $h_1$, $h_2$ and $h_3$ of rolling reduction are selected as the section set value 79. In view of the characteristic of the shape of the curve D, the sectioning is made at a higher density at the portion of the curve close to the origin of coordinates. More specifically, $h_1$, $h_2$ and $h_3$ are so selected as to satisfy the equation of $h_1 = \frac{1}{3}h_2 = 1/6\ h_3$. The roll deflections corresponding to the reductions $h_1$, $h_2$ and $h_3$ are represented, respectively, by p1, p2 and p3.

Then, a line E interconnecting the points 0, p1, p2, p3 is assumed, although it is not necessary determine this line actually. This line E can be regarded as a roll deflection correction curve which approximates the curve D. Making use of this curve E, the approximate value of the roll deflection for a given rolling reduction can be determined quite easily as follows.

| | |
|---|---|
| (i) in case of $h \leqq h_1$ | $p = K_1 h$ |
| (ii) in case of $h_1 < h \leqq h_2$ | $p = K_1 h_1 + K_2 (h - h_1)$ |
| (iii) in case of $h_2 < h \leqq h_3$ | $p = K . h_1 + K_2 (h_2 - h_1) + K_3 (h_2 - h_3)$ |

In these equations, k1, k2 and k3 represent constants or gradients of the three sections of the line E.

It will be understood that the dimensional error attributable to the roll deflection, which changes instantaneously in accordance with the change in the rolling reduction, can be eliminated to ensure a higher precision of the plate material, by controlling the rolling reduction in accordance with the curve (curve C) which is obtained by adding the roll deflection correction curve E to the rolling reduction instruction curve A'. Although the curve obtained as the result of the correction is shown as curve C in FIG. 14, it is not always necessary to obtain this curve.

Figure 16:
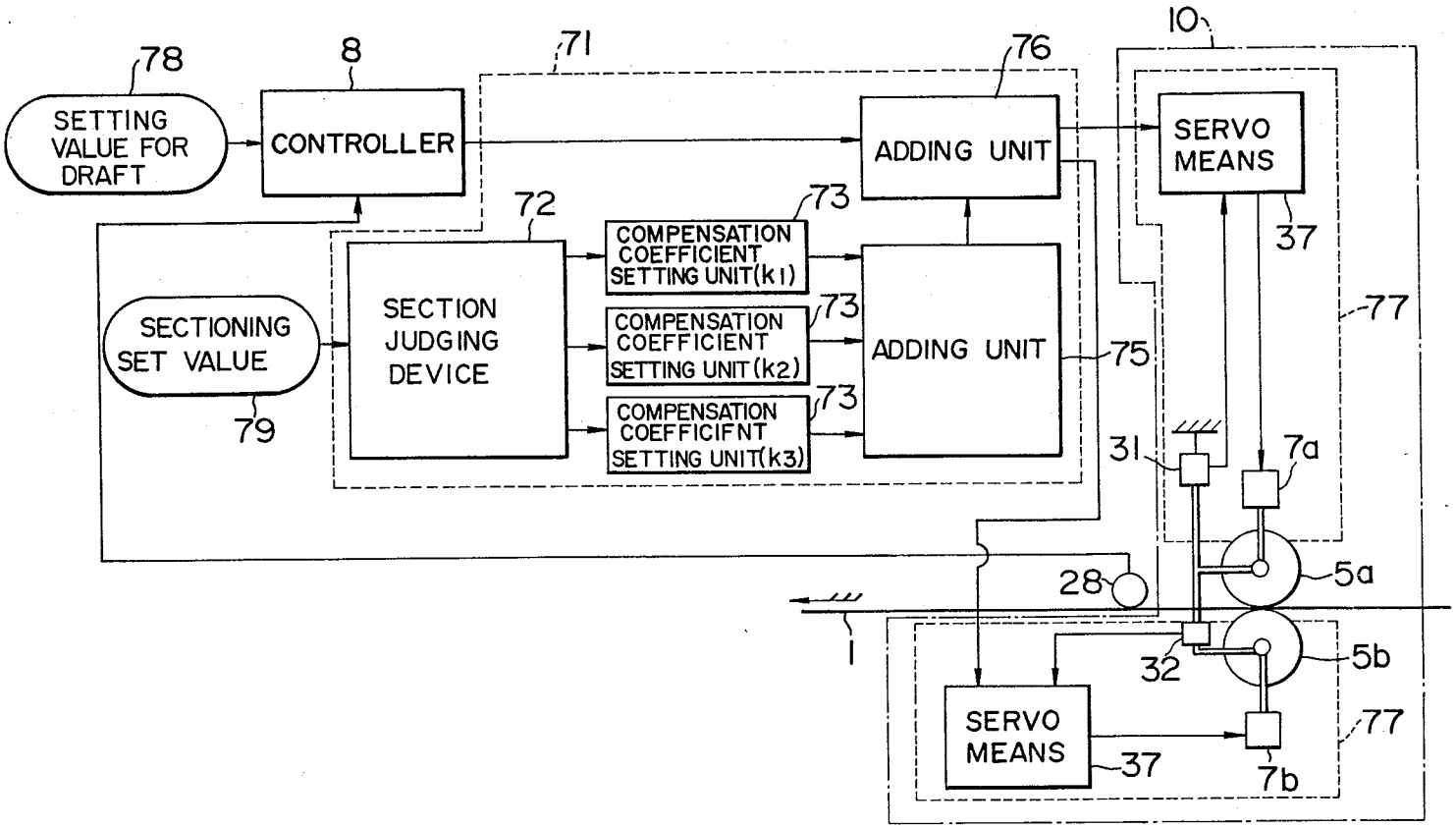
FIG. 16 is an illustration of an example of apparatus capable of carrying out the method of the invention.

The described method can be carried out by the use of, for example, an apparatus as shown in FIG. 16.

Referring to FIG. 16, a reference numeral 8 denotes a controller which provides the rolling reduction instruction. The controller 8 is adapted to give a command rolling reduction to the rolling mill 10, upon receipt of the signal representing the travelling amount of the work 1 delivered by the travelling amount measuring device 28, in accordance with the conditions of rolling reduction set value 78.

The rolling mill 10 has a reduction device 77 which includes a pair of thicknesswise rolling rolls 5*a*, 5*b*, roll adjusting mechanism 7 for changing the roll gap between the rolls 5*a*, 5*b*, servo means 37, and roll position sensing devices 31, 32. A roll deflection compensation means 71 is provided between the controller 8 and the reduction device 77. The instruction given by the controller 8 in the form of a voltage is divided into sections and delivered to a section judging device 72. The section judging device 72 is adapted to judge the section to which section of the first section, second section and the third section the present rolling reducing belongs, in accordance with the previously set section setting value, and delivers the voltage to the selected one of compensation coefficient setting devices 73*a*, 73*b* and 73*c*. Also, the section judging device 72 holds the maximum value of the voltages of each section below the judged section. The compensation coefficient setting device 73*a*, 73*b* and 73*c* are provided with variable resistors and the number of these devices corresponds to the number of sections of division, i.e. to the number of sections of the line E. Thus, in the described embodiment, there are provided three setting devices, so as to determine and set the coefficients or gradients k1, k2, k3 of the respective sections of the line E. The value of the coefficients k1, k2, k3 can be changed to correspond to lines having various gradients of sections, by rotating the knobs of respective variable resistors.

The voltage which has been passed the compensation coefficient setting device (73*a*, 73*b* or 73*c*) selected by the section judging device 72, and thus representing the roll deflection corresponding to that section, is added to the voltages corresponding to the deflection amounts of respective sections which are derived from respective compensation coefficient setting devices which receive the aforementioned maximum voltages held by the device 72, by means of an adder 75. The instant total roll deflection is thus calculated and delivered to an adder 76.

The adder 76 is adapted to add this total deflection to the instruction given by the controller 8, so that the final rolling reduction instruction corresponding to the curve C shown in FIG. 14 is calculated.

In accordance with this final rolling reduction instruction, the reduction device 77 constituted by the serve means 37, roll adjusting mechanism 7 and the roller position sensing devices 31, 32 is actuated to effect the desired rolling.

In the embodiment shown in FIG. 16, the rolling reduction set value 78 is set in the controller 8, and the rolling reduction instruction is issued in accordance with this set value 78 in relation to the travelling amount of the work 1.

In order to obtain a higher precision of the product, the shape function set in the controller may be corrected with a correction function for eliminating the dimensional error attributable to the change in the roll outlet point, i.e. the deviation of the point at which the work leaves the roll, which change being caused by the change of slope of the work surface, and to deliver the reduction instruction in accordance with thus corrected shape function.

In the illustrated embodiment, the rolling reduction is divided into a plurality of sections, because the roll deflection usually changes along a complicated curve D in relation to the change in the rolling reduction, so that the line E approximating this curve must be divided into sections.

However, in a specific case in which the curve D approximate a straight line, the number of sections and, hence, the number of the compensation coefficient setting devices 73*a*, 73*b* . . . can be reduced.

Although the rolling mill as shown in FIG. 16 has a pairs of reduction devices 77, 77 to control the positions of both of the rolls 5*a*, 5*b*, the described embodiment can equally be applied to the case where only one reduction device is employed to control either one of the rolls.

In the embodiment shown in FIG. 16, the roll deflection compensation device 71 is provided with two separate adders 75 and 76. This, however, is not exclusive, and two adders may be built as a single adder.

As has been described, according to the invention, the rolling is effected while making a compensation for the roll deflection, in accordance with the instruction given by the controller, by means of a roll deflection compensation device disposed between the reduction device and the controller, so as to ensure a remarkably high precision of the final product. In addition, the compensation for the roll deflection can be achieved by quite a simple device, by employing a plurality of sections of straight line which approximate the relation between the rolling reduction and the roll deflection.

Hereinafter, a description will be made as to a method of and an apparatus for precisely shearing an elongated material having a plurality of regular lengthwise thickness variation into independent pieces of desired size.

Figure 17:
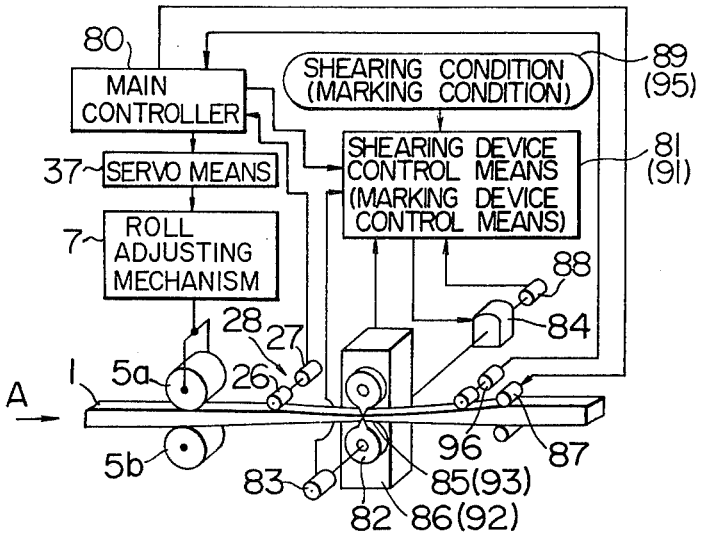
FIG. 17 is an illustration of a first example of a device for precisely shearing an elongated half-finished material having a plurality of lengthwise thickness variation into separate plate materials.

Referring to FIG. 17, a pair of opposing drum shears 86 are disposed at the downstream side of the travelling amount measuring device 28. Each drum shear 86 is provided with a steel drum 82 carrying a cutting blade 85 fixed thereto. Another travelling amount measuring device 96 and a pair of pinch rollers 87 are disposed at the downstream side of the shears 86.

The roll positions of the thicknesswise rolling rolls 5*a*, 5*b* are controlled in accordance with the instructions given by a main controller 80. The main controller stores the thickness variation in relation to the length of the product, in accordance with the kind of the product. The main controller 80 calculates the command roll gap in relation to the length of the work 1 from the set condition and the signal delivered by the travelling amount measuring device 28, and delivers the result of the calculation to the servo mechanism 5 of the rolling mill. The controlled result of the roll gap is measured by the roll gap measuring device and, if the measured value does not coincide with the command roll gap, the servo means effect a control to nulify the difference between the actually measured roll gap and the command roll gap. The roll gap is thus controlled in accordance with the instruction given by the main controller 80. By such a control, the rolling mill imparts to the work 1 a regular lengthwise thickness variation to form a half-finished product 1'''. The half-finished product thus formed is then shorn at predetermined portions into final products of unit length. The control of the shearing is effected in the manner described below.

For shearing the half-finished product at a desired portion, e.g. at the mid point of the portion of the minimum thickness, the main controller 80 delivers a command value of the roll gap corresponding to this shearing position of the servo means, and, at the same time, issues a shearing position shaping signal. Then, a shearing device control means 81 controls the driving means 84 of the shearing device 86, such that the shearing blade 85 shears the destined portion of the shearing, while moving at the same velocity as the work 1, when the destined portion of the work 1 to be shorn passes the shearing device 86, in accordance with the result of measurement made by the work travelling amount measuring device 28 after the delivery of the shearing position shaping signal, and in accordance with the output from a blade position detector 83 which detects the instant position of the shearing blade 85 of the shearing device 86. Cutting conditions such as the peripheral length of the circle scribed by the edge of the cutting blade 85 are input to the shearing device control means 81.

A tacho-generator 88 is provided for detecting the actual rotation speed of the driving means 84, in order to control the rotation speed of the latter.

Thus, the position of shearing is determined precisely and correctly by the measurement of the travelling amount of the work after a reference moment at which the shearing position shaping signal is delivered, i.e. in relation to a distinct reference point for the shearing, even when the cross-section of the work changes periodically in quite a small rate. Therefore, it is possible to shear the half-finished product precisely at the desired portion of the latter. In addition, since the travelling distance measuring device 28 is reset preriodically, the measurement is commenced newly at each time of delivery of the shearing position shaping signal. Therefore, the accumulation of error by the repetition of the shearing is fairly avoided.

The travelling amount measuring device 96 and the pinch rollers 87 are provided for pulling the half-finished product 1''' and to measure the travelling distance, when the remainder part of the half-finished product 1''' has become short to clear the rolls 5*a*, 5*b* and the travelling amount measuring device 28. By so arranging, it becomes possible to efficiently use the material to the last portion thereof.

Hereinafter, a description will be made as to a device which has a marking control device adapted to be used in place of the shearing device control device, so as to effect a marking on the portions to be shorn of the half-finished material.

In this case, the shearing device 86 of the apparatus shown in FIG. 17 is replaced with a marking device 92 having a marking tool 93, and the shearing device control means 81 is substituted by a marking device control means 91. The marking device control means 91 controls the marking device 92 to provide a mark K on the portion of the half-finished material 1''' to be shorn. The process down to the marking is usually carried out while the work 1 is still hot.

Figure 18:
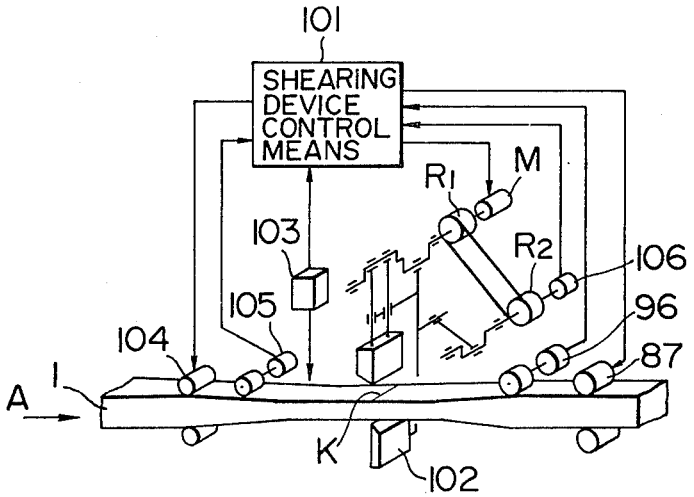
FIG. 18 is an illustration of a second embodiment of a shearing device.

An apparatus as shown in FIG. 18 is used for shearing the half-finished product correctly at the marked positions into separate final products. The shearing in this case is in the cold state of the work, i.e. in a line which is separate from the flow of the work 1 in the previously described embodiment.

The mark K provided by the marking tool 93 may be a scratch by a cutting edge, indentation by a punch or a line drawn with a paint. The marking device 93 may have a construction similar to the drum shear as shown in FIG. 17, or may be a device adapted to impart a indentation instantaneously.

The marking device 92 is preferably of a flying type which is adapted to provide a mark while moving at the same speed as the work 1. This, however, is not exclusive, and the marking device may be stationary, because the marking can be made in quite a short time, i.e. instantaneously.

The travelling amount measuring device 96 and the pinch rollers 87 are provided, as in the case of the previously described shearing of the half-finished product, for, moving the half-finished product 1''' and effecting a marking on the latter, after the trailing end of the half-finished material has cleared the roll 5 and the travelling amount measuring device 28. By so arranging, it becomes possible to correctly provide a mark for the final portion of the half-finished product 1'''.

The half-finished product 1''' is then picked up by the apparatus shown in FIG. 18 and is moved continuously in the direction of arrow A, by means of pinch rollers 104 which are disposed at the upstream side of the shearing device 102. The travelling amount of the half-finished product 1''' is measured by a travelling amount measuring device 105 which is located also at the upstream side of the shearing device 102.

At the downstream side of the travelling amount measuring device 105, disposed is a photoelectric mark detector 103 which is adapted to direct a light beam to the surface of the half-finished product and to detect the presence of the mark through a change of amount of reflected light caused by the presence of the mark. The shearing device 102 which may be a known pendulum shear is disposed at the downstream side of the mark detector 103. The aforementioned travelling amount measuring device 96 and the pinch rollers 87 are disposed at the downstream side of the shearing device 102.

In operation, the half-finished product 1''' is delivered by the pinch rollers 104. As the marked portion of the half-finished product 1''' passes the mark detector 103, a mark passage signal is delivered by the mark detector 103.

The shearing device controller 101 then controls the driving means such as motor M, reduction gear $R_1$ and associated reduction gears $R_2$ for the shearing device 102, such that the shearing blade shears the half-finished product 1''' precisely at the portion to be shorn, while moving at the same speed as the half-finished product 1''', in accordance with the result of measurement made by the travelling amount measuring device 105 after the delivery of the mark passage signal and in accordance with the output from a blade position detector 106 adapted for detecting the position of the shearing blade of the shearing device 102.

As is the case of the previously described shearing of the half-finished product the travelling amount measuring device 96 and the pinch roller 87 are provided for shifting the half-finished product 1''' and for measuring the travelling amount, even after the trailing end of the half-finished product has cleared the pinch rollers 104 and the travelling amount measuring device 105. By so doing, it becomes possible to make efficient use of the final portion of the half-finished material.

In the described shearing in cold state of the half-finished product 1''', the deformation of the shearing portion is small as compared with the case of the hot shearing, so that it becomes possible to obtain a product having precise dimensions and, hence, a high commercial value.

In the described embodiment, the process down to the marking is performed while the half-finished product is still hot, while the shearing is made in the cold state. This, however, is not exclusive, and the whole process including the shearing step may be made throughly in a hot or cold state. The shearing device may be driven automatically by a power, or by means of manual control. Non-contact type measuring device such as an image sensor may be used as the travelling amount measuring devices 28, 96, 105. Further, other constituents may be substituted by various alternative means without departing from the scope of the invention.

Hereinafter, a description will be made with specific reference to FIGS. 19, 20 and 21, as to a controller for obtaining a further higher precision of the product making use of the production apparatus as shown in FIG. 1.

Figure 19:
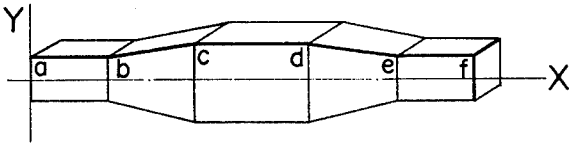
FIG. 19 is a perspective view of a plate material having varying thickness as produced by the apparatus of the invention.
Figure 20:
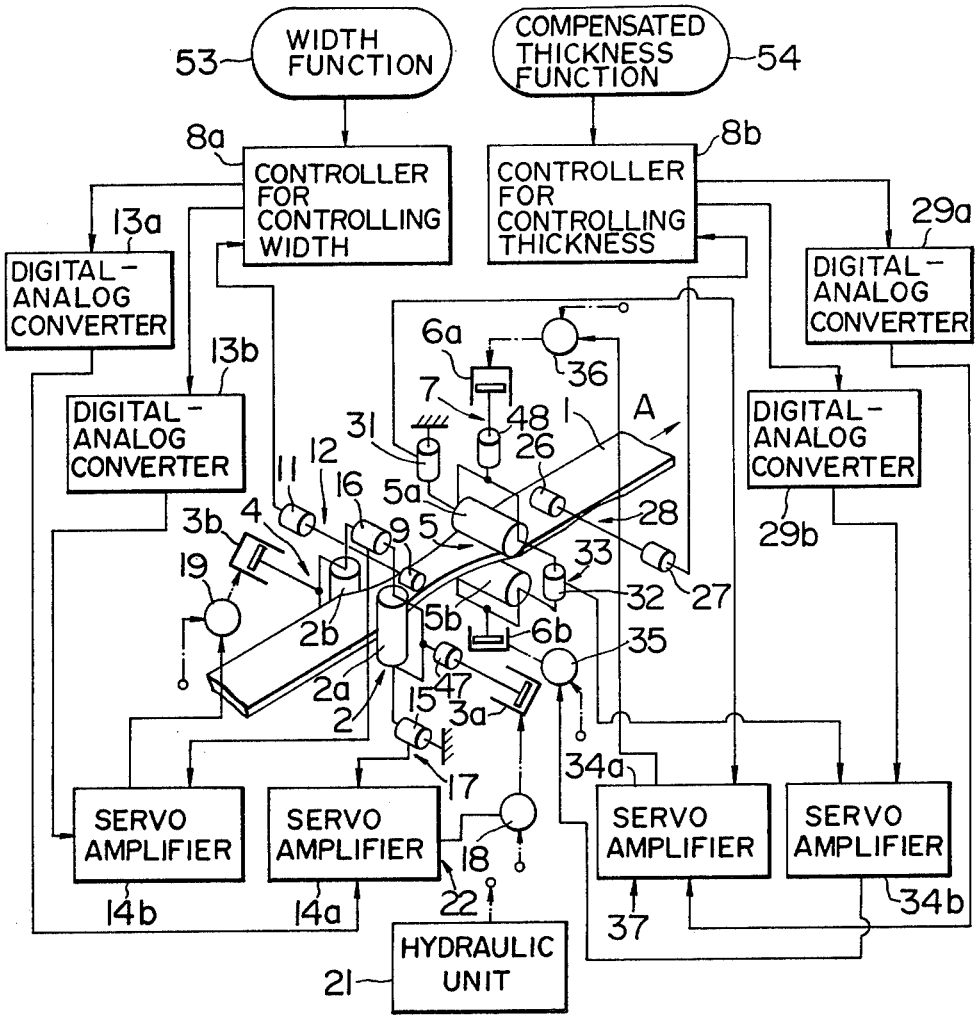
FIG. 20 is a perspective view of an apparatus which is another embodiment of the invention, together with block diagram.

FIG. 19 shows an example of the shape of the product to be obtained. This shape is symmetrical with respect to the X axis and is defined by straight line sections interconnecting points a, b, c, d and e. Actually, in most cases, the product has a smooth continuous curves passing these points.

Referring first to the device for controlling the widthwise rolling rolls 2*a*, 2*b*, the travelling amount of the work 1 is detected by means of a first travelling amount measuring device 12 which includes a measuring roller 9 adapted to rotate in contact with the work 1 as the latter moves and an encoder adapted to generate a pulse for each of unit rotation angle of the roller 9, and is delivered to a calculating means for width control 8*a*. The calculating means 8*a* is adapted to calculate from the signal derived from the encoder 11 and also from a previously set width function 53 which will be described later, the command roll position in relation to the length of the work 1, and delivers the result of the calculation as an output.

The digital output from the calculating means for width control 8*a* is converted into analog signal by means of D/A (digital to analog) converters 13*a*, 13*b* and then delivered to servo amplifiers 14*a*, 14*b* which receive also the outputs from differential transmitters 15, 16 which in combination constitute a roller position sensing device 17. The servo amplifiers deliver to the servo valves 18, 19 outputs which correspond to the differences between the inputs from the transmitters 15, 16 and the inputs from the D/A converters 13*a*, 13*b*. As a result, the servo valves 18, 19 are actuated to permit the hydraulic unit 21 to deliver pressurized oil to the hydraulic cylinders 3*a*, 3*b* which in turn changes the positions of the widthwise rolling rolls. The servo valves 18, 19 are de-energized when the inputs from the differential transformers 15, 16 have become equal to the inputs from the D/A converters 13*a*, 13*b*. Thus, the widthwise rolling rolls 2*a*, 2*b* are set at positions as instructed by the calculating means 8*a*. Thus, the roll position sensing device 17, servo amplifiers 14*a*, 14*b*, servo valves 18, 19 and so forth in combination constitute a width control servomeans 22 which controls the roll adjusting mechanism 4 in accordance with the output from the calculating means 8*a*.

The control of the thicknesswise rolling rolls 5*a*, 5*b* are made substantially in the same manner. More specifically, the travelling amount of the work 1 is detected by means of a second travelling amount measuring device 28 having a measuring roller 26 and an encoder 27. Then, a calculating means 8*b* for calculating the thickness calculates the command roll positions in accordance with the result of measurement by the measuring device 28 and a compensated thickness function 54 which has been beforehand set in the calculating means 8*b*. The compensated thickness function 54 will be described later. The result of the calculation is converted into analog signal by means of the D/A converters 29*a*, 29*b*. A thickness controlling servo means 37 constituted by the servo amplifiers 34*a*, 34*b*, servo valves 35, 36 and the roll position sensing device 33 including the differential transformers 31, 32 control the roll reduction device 7 which include cylinders 6*a*, 6*b*, whereby the positions of the thicknesswise rolling roll 5*a*, 5*b* are controlled in accordance with the instructions given by the calculating means 8*b* for the thickness control.

Hereinafter, a detailed description will be made as to the calculating means 8*a* and 8*b* for width control and thickness control, as well as to a calculating means for pre-treatment, with specific reference to FIG. 21.

Figure 21:
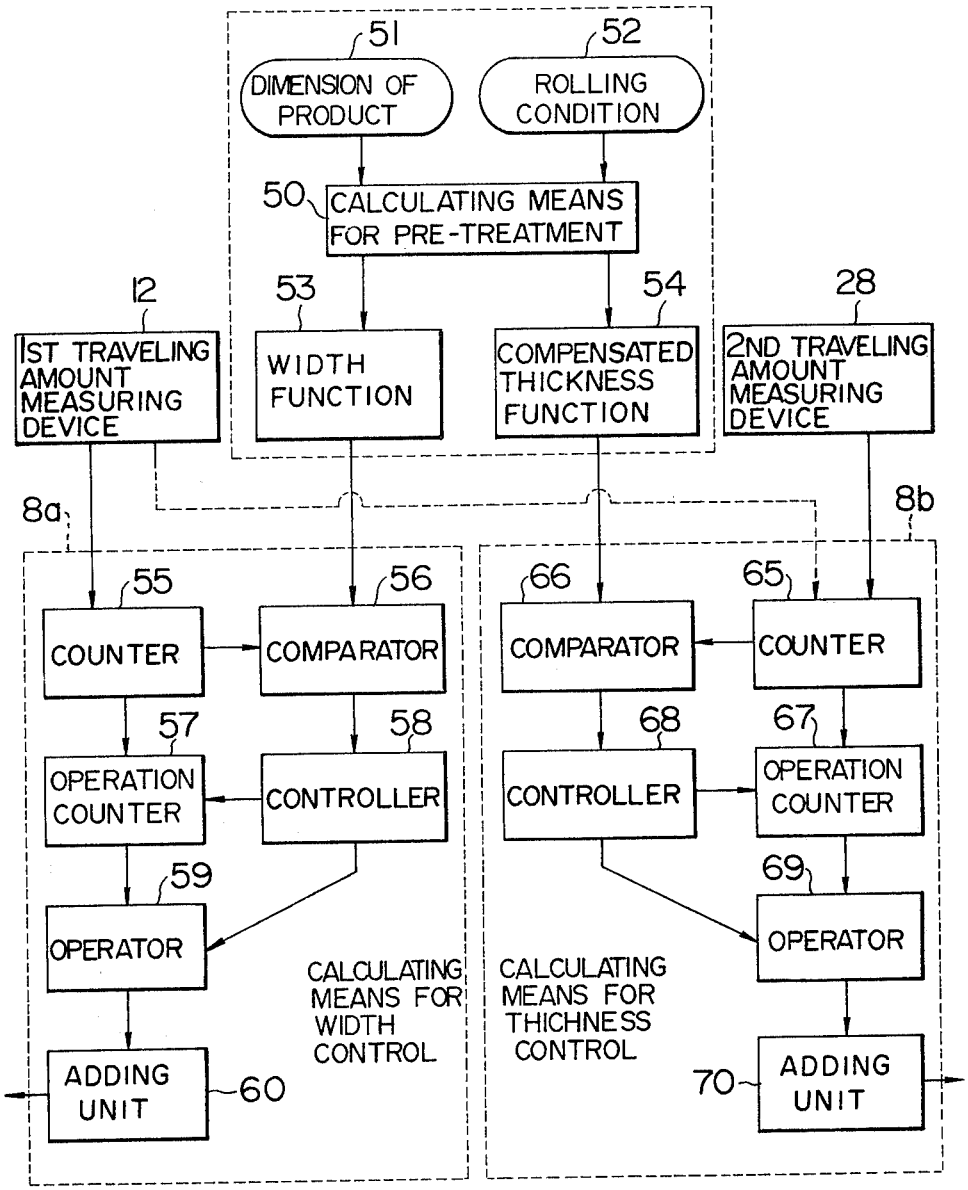
FIG. 21 is a block diagram of the essential part of the apparatus shown in FIG. 20.

Referring to FIG. 21, a reference numeral 50 denotes a calculating means for pre-treatment into which are put the desired product shape 51, as well as rolling conditions such as material of the work, rolling temperature, rolling speed, roll diameter and so forth. With these data, the calculating means 50 calculates a width function 53 which represent the position and amount of width reduction in relation to the length of the work 1 to be made by the widthwise rolling rolls such that the product processed by a subsequent thicknesswise rolling by the thicknesswise rolling rolls 5*a*, 5*b* has a constant width over entire length thereof.

The calculating means 50 for pre-treatment also works out a compensated thickness function 54 which is obtained by effecting a compensation or correction on a thickness function which represents the thickness variation of the final product in relation to the length, so as to eliminate the deviation of the size of the final product from the designated size, the deviation being expected to occur during the rolling by the thicknesswise rolling roll carried out in accordance with the thickness function, due to the influence of at least one of the roll diameter and roll deflection.

To explain in more detail about the compensation or correction, the roll diameter and the roll deflection are selected as major factors of compensation or correction, because, in the hot rolling to which the invention is applied, the rolls exhibit a large thermal expansion and because the rolling is effected with varying rolling reduction force to cause a large change in the roll deflection, which in turn adversely affect the shape and size of the final product.

As to the width function 53 and the compensated thickness function 54, in case that the product has five sections as shown in FIG. 19: two flat end sections, a flat central section and two tapered sections through which the flat central section is connected to both flat end sections, the width function 53, as well as the compensated thickness function 53, has different forms or expressions corresponding to these sections. More specifically, these functions do not always have forms or expressions corresponding to the five sections. Namely, the borders between adjacent sections are preferably expressed by a function which is different from those of the adjacent sections. In such a case, the functions are prepared for more than five sections. However, for an easier understanding of the invention, it is assumed here that the width function 53 have different forms or expressions corresponding to the five sections of the product. At the same time, the functions such as width function 53 are expressed, selecting the starting point of each section as the origin of coordinates, by the coordinate in abscissa and an equation inherent in each section. Thus, the coordinates and equations corresponding to the five sections of the product constitutes the width function 53 and compensated thickness function 54, for one control cycle.

The width function 53 and the compensated thickness function 54 thus determined are delivered to the calculating means 8*a* for width control and calculating means 8*b* for thickness control, respectively. These calculating means 8*a* (8*b*) is constituted by a counter 55 (65), comparator 56 (66), operation counter 57 (67), controller 58 (68), operation unit 59 (69) and adder 60 (70).

Referring first to the calculating means 8*a* for the width control, the counter 55 is adapted to count the pulses which are delivered by the aforementioned first travelling amount measuring device 12 in accordance with the travel of the work 1. The comparator 56 is adapted to judge what section of the five sections of the product is being processed, from the result of the count made by the counter 55 and the width function 53, and delivers the result of the judgement to the controller 58.

The controller 58 delivers a reset signal to the operation counter 57, at the starting of each section, and selects the function corresponding to the started section. The controller 58 then instructs the operation unit 59 to make an operation in accordance with the selected function. The operation unit 59 then calculates the change of the roll gap for unit length of abscissa, in accordance with the selected function and the result of counting of pulse conducted by the operation counter 57 for each section, and delivers the calculated change of the roll gap to the adder 60. The adder 60 makes an addition of the delivered change of roll gap and calculate the value of the function, i.e. the positions of the widthwise rolling rolls, and delivers the calculated roll position signals to the D/A converters 13*a*, 13*b* shown in FIG. 20. In consequence, the widthwise rolling pull adjusting mechanism 4 is actuated by the servo means 22 for the width control including the servo amplifiers 14*a*, 14*b*, servo valves 18, 19 and so on, so as to control the positions of the widthwise rolling rolls 2*a*, 2*b*.

The calculating means 8*b* for the thickness control operates substantially in the same manner as that for the width control. The counter 65 counts the pulses delivered by the second travelling amount measuring device 28, and delivers the result of the counting to the comparator 66. The comparator 66 judges what section of the five sections of the final product shape is being processed, from the result of the counting and the compensated thickness function, and delivers the result of the judgement to the controller 68.

The controller 68 delivers a reset signal to the operation counter 67 at the starting of each section, and selects the function corresponding to the started section. The controller 68 then instructs the operation unit 69 to make an operation in accordance with the selected function. The operation unit 69 then calculates the change of the roll gap per unit length of abscissa, in accordance with the selected function and the result of the counting of the pulses conducted by the operation counter 67 for each section, and delivers the calculated change of roll gap to the adder 70. The adder makes an addition of the delivered change of the roll gap and calculates the positions of the thicknesswise rolling rolls. The signals representing the calculated roll positions are then delivered to the D/A converters 29*a*, 29*b* as shown in FIG. 20. In consequence, the servo means 37 for thickness control actuates the thicknesswise rolling roll adjusting mechanism 7 to control the positions of the thicknesswise rolling rolls.

A description will be made hereinunder as to how the plate material having uniform width and a lengthwise thickness variation is rolled by the apparatus having the described construction.

First of all, the thickness function representing the thickness of the final product in relation to the length is determined in accordance with the shape of the final product to be obtained. Then, making use of this function, the calculation means 50 for the pre-treatment calculates the width function 53 which would provide a uniform width over the entire length of the final product, compensating for the increment of the width of product which would be caused when the work 1 is rolled by the thicknesswise rolling rolls 5. Factors such as material of the work, rolling temperature, rolling speed, roll diameter and so forth are used as factors in the determination of the width function.

Then, the amount of deviation of size from the designated size of the final product, which is expected to be caused by a control of the thicknesswise rolling rolls 5*a*, 5*b*, is put in the calculation means 50 together with the aforementioned thickness function, to make the calculation means 50 calculate and work out the compensated thickness function 54. Influences of roll diameters, roll deflection and so forth are used as the compensation or correction factors, in the determination of the compensated thickness function 54.

The preparation for the rolling is completed as the width function 53 and the compensated thickness function 54 are put in the calculation means 8*a*, 8*b* for the width and thickness control, respectively.

As the preparation for the rolling is over, the work 1 is introduced into the roll gap between the widthwise rolling rolls 2*a*, 2*b*. Then, as the first travelling amount measuring device 12 is moved into contact with the work 1, the device 12 starts to produce pulses. These pulses are delivered to the calculation means 8*a* for the width control.

The calculation means 8*a* then calculates instant command roll gap for each moment from the output of the width function 53 and pulses delivered by the first travelling amount measuring device 12, as the work 1 is moved ahead, and delivers the instant command roll gap thus calculated to the servo mechanism 22 for the width control.

The width control servo mechanism 22 periodically move the widthwise rolling rolls 2*a*, 2*b* toward and away from each other, so as to form an intermediate material having a regular lengthwise width variation.

Then, the intermediate material thus formed is introduced into the roll gap of the thicknesswise rolling rolls 5*a*, 5*b*. The second travelling amount detecting device 28 starts to deliver pulses as it is brought into contact with the intermediate material to the calculation means 8*b* for the thickness control. The calculating means 8*b* then calculates the instant command roll gap of the thicknesswise rolling rolls, as the work 1 is moved, in accordance with the output from the compensated thickness function 54 and the pulses derived from the second travelling amount detecting device 28. The instant command roll gap thus calculated is delivered to the servo means 37 for the thickness control.

The servo means 37 then controls the thicknesswise rolling rolls 5*a*, 5*b* in accordance with the instruction, so as to produce a product having a uniform width and a regular lengthwise thickness variation.

It is to be noted that the pulse signal coming from the first travelling amount detector 12 is delivered to the counter 65 in the calculation means 8*b* for the thickness control, so that the timing of start of counting operation of the counter 65 and that of the counter 65 on the same work 1 are forcibly made to coincide with each other. If the controls of the widthwise rolling rolls 2*a*, 2*b* and the thicknesswise rolling rolls 5*a*, 5*b* are made independently of each other, the point of start of the thickness variation are offset from each other, due to the dimensional error in the lengthwise direction of the work 1. Such offset will gradually grows large as the adjusting cycles are repeated due to an accumulation of the dimensional error. However, according to this embodiment, such an offset is completely eliminated, because the timings of commencements of the counting operations of the counters 55 and 65 are forcibly made to coincide with each other, as stated above.

Although in the described embodiment two separate calculating means 8*a*, 8*b* are used independently for the width control and thickness control, this is not exclusive and the functions of these calculating means may be performed by only one calculating means.

In the described embodiment, the compensated thickness function 54 is calculated by the calculating means 50 for the pre-treatment, in order to eliminate the errors which may be incurred due to the influence of roll changes in the roll diameter and the roll deflection. It is possible to work out a compensated width function by correcting the width function 53 in the same manner.

Further, the width function 53 and the thickness function 54 may be represented over all sections with reference to a common origin of coordinate.

As has been described, according to the invention, the widthwise rolling rolls 2*a*, 2*b* and the thicknesswise rolling rolls 5*a*, 5*b* are controlled in accordance with functions which have been beforehand corrected or compensated taking into account various factors such as material of the work, rolling temperature, rolling speed, roll diameter and other rolling conditions, as well as influences of changes in the roll diameter and roll deflection. In addition, complicated measuring and controlling devices which are necessary in the conventional system relying upon the feedback of the actually measured size of the product are completely eliminated to remarkably lower the installation cost.

In addition, troublesome calculations which need not be made simultaneously with the rolling operation have been treated previously by the calculating means for the pre-treatment, while the calculations which must be made simultaneously with the rolling operation are performed by the calculating means for the width control and thickness control promptly at the site of rolling. By this separation is much simplified to further reduce the cost of system as a whole.

Another example of the device for measuring the travelling amount of the work will be described hereinunder with reference to FIGS. 22 to 23.

Figure 22:
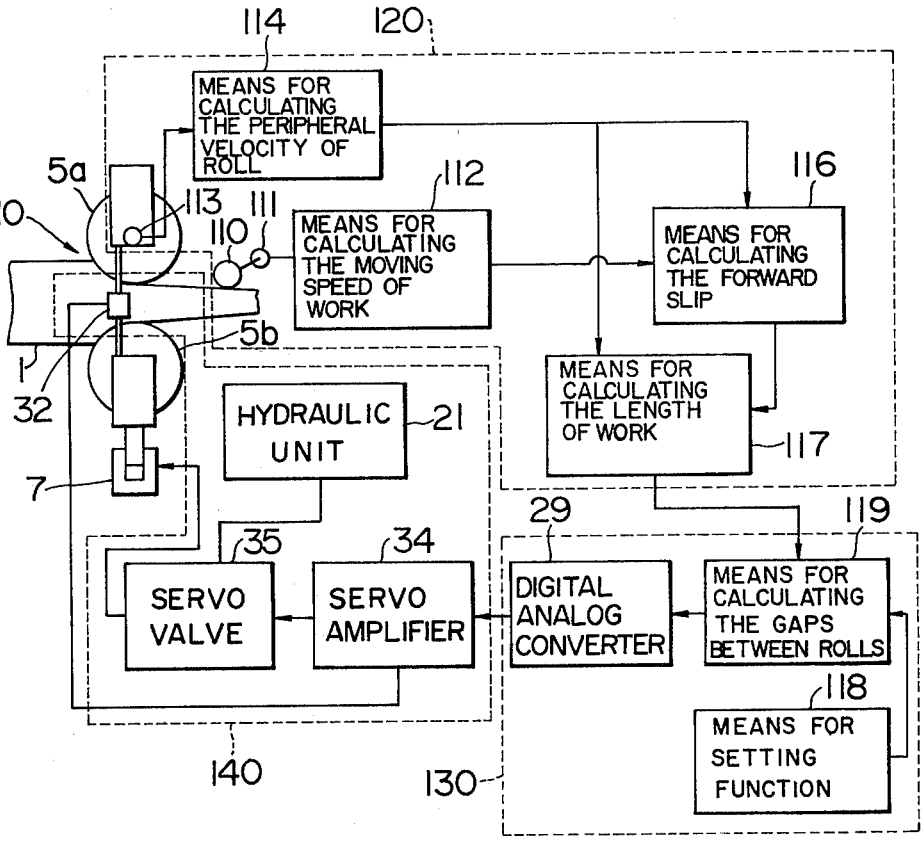
FIG. 22 is a schematic illustration of another example of the travelling amount measuring device as used in the apparatus of the invention for producing plate materials having varying thickness.

Referring to FIG. 22, the controller controlling a rolling mill 10 has a rolling length measuring section 120 which measures the rolling length of the work 1, roll-gap instruction section 130 which is adapted to calculate instant roll-gap command which varies continuously in accordance with the change of the rolling length and to provide an instruction concerning the command roll gap, and a servo section 140 which is adapted to control the roll adjusting mechanism 4 such that the actual roll gap always coincide with the command roll gap.

The rolling length measuring section 120 has an encoder 113 which is attached to the sahft of the roll 1 and adapted to act as a device for measuring the rotation speed of the roll. The encoder 113 is adapted to deliver to a roll-periphery-speed calculation means 114 pulses corresponding to the rotation speed of the roll 1. The roll-periphery-speed calculating means 114 calculates the peripheral speed v of the roll 1 from the pulse signals and the previously determined radius of the roll 1. The roll peripheral speed v is delivered to a calculating means 116 for forward slip, and also to the rolling length calculating means 117.

The rolling length measuring section 120 is also provided with a detection roller 110 which rolls in contact with the work 1 at the outlet side of the rolling mill 10, and an encoder 111 as means for measuring the rotation speed of the roller 110. The pulse signal delivered by the encoder 111 is delivered to the work outlet speed calculating means 112 which is adapted to calculate the speed u of the movement of the work 1 from the pulse signals and the radius of the detecting roller 110, and deliveres the result of the calculation of the calculating means 116 for the forward slip.

The calculating means 116 for the forward slip then calculates, making use of the work speed u and the roll peripheral speed v as delivered by the roll-peripheral-speed calculation means 114, the forward slip f which is given by $f=(u-v)/v$.

More specifically, the instant moving speed u of the work 1 and the instant roll peripheral speed v are picked up at each unit time $\Delta t$ to obtain instant values ui and vi (values at instant $\{t\times i)$, and the instantaneous forward slip is determined in accordance with the equation of $fi=(ui-vi)/vi$. However, the calculation means 116 for the forward slip does not delivers directly the calculated result. Namely, it compares the calculated value with a previously set reference value and delivers the larger one as the forward slip fi for each time length $\Delta t$.

The reference values set in the calculating means 116 for the forward slip is preferably the value which is greatest but would not exceed the actual forward slip, in order to eliminate the error which may be caused by a skipping of the detection roller 110 or the like reason. For instance, the reference value is selected as a value which varies continuously and which coincides with the value which is obtained by subtracting the possible error from the forward slip which is estimated theoretically in accordance with the rolling reduction in the rolling mill 10 or in accordance with data which have been accumulated beforehand. The reference value, however, may be fixed at a theoretically conceivable minimum value, i.e. 0 (zero). The method of the invention is still effective even in this case, as will be understood from the explanation which will be given later.

The forward slip f and the roll periphery speed v thus obtained are delivered to the roll length calculating means 117 which in turn calculates the travel distance of the roll surface in accordance with an equation $S=\int v\,dt$. The correction is made on the travel distance S to eliminate the influence of the forward slip f, and the rolling length is calculated in accordance with an equation $a=S+\int v\,f\,dt$.

More practically, the instantaneous value vl of the roll periphery speed is picked up by the rolling length calculated means 117 at each period of $\Delta t$, simultaneously with the picking up of the work speed u and the roll periphery speed v by the calculating means 116 for the forward slip. The travel distance of the roll surface is then calculated in accordance with the following equation, from the instantaneous roll periphery speed vi and the instantaneous forward slip fi as calculated by the calculating means 116.

$$S=\Sigma_{vi}\,\Delta t$$

Further, the rolling length is calculated in accordance with the equation of:

$a = S + \Sigma_{vi} fi \, \Delta t$

The rolling length thus calculated is then transmitted to the roll-gap instructing section 130. The roll-gap instruction section 130 is provided with a roll-gap calculating means 119, and function setting means 118 adapted to set the function representing the relation between the rolling length a and the roll gap h (referred to as roll-gap function, hereinafter) h=g(a) and the initial value ho of in this calculating means 119.

The roll-gap function h=g(a) is determined in accordance with the function b=g(l) which is determined in accordance with the relationship between the lengthwise position l and the thickness of the final product.

The function b=g(l) may be used directly as the function h=g(a), when the requirement for the precision is not so strict. The roll-gap function a=g(a) is given as a function which corresponds to one cycle of thickness variation of the product. Generally, this function is given as an aggregation of equations which correspond to respective sections of the shape of the product. The roll-gap calculating means 119 are adapted to calculate the command roll gap which varies continuously in accordance with the rolling length, from the output of the rolling length calculating means 117, the roll-gap function h=g(a) and the initial value ho of the function. The calculated command roll gap is then delivered to the servo means section 140 through a digital to analog converter 29.

The servo means section 140 is provided with a roll-gap measuring device 32 incorporating a differential transformer and adapted for measuring the gap between the thicknesswise rolling rolls 5*a*, 5*b*. The roll adjusting mechanism 7 of the rolling mill 10 is controlled to maintain a coincidence of the roll gap measured by the roll-gap measuring device 32 with the command roll gap delivered by the roll gap calculating means 119. Namely, when the actually measured value of the roll gap has been offset from the command roll gap, the servo amplifiers 34 delivers an output voltage corresponding to the offset to the servo valve 35 which in turn operates by an amount corresponding to the voltage to permit a hydraulic unit 21 to deliver a pressurized oil to the hydraulic cylinder of the roll adjusting mechanism 7 so as to change the roll-gap between the thicknesswise rolling rolls 5*a*, 5*b*, thereby to maintain the coincidence of the actual roll gap with the command roll gap.

Figure 23:
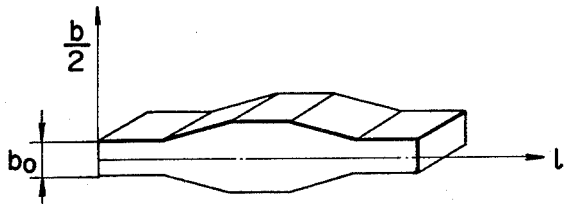
FIG. 23 is a perspective view of an example of the product produced by the apparatus shown in FIG. 22.

The operation of the apparatus having the described construction will be described hereinunder with specific reference to a case where an elongated material having a plurality of tapered leaf blanks each having a shape as shown in FIG. 23.

As will be seen from FIG. 23, the tapered leaf blank has a central thick flat section, comparatively thin flat end sections and tapered sections interconnecting these flat sections, i.e. five sections in all. Therefore, the sahpe function b=g(l) representing the shape of the tapered leaf is given in the form of five different equations.

For an easier understanding of the invention, it is assumed here that the shape function b=g(l) is directly used as the function h=g(a). This shape function and its initial value bo are set in the function setting means 118. Simultaneously, the radius of the roll 5*a* is set in the roll-periphery-speed calculating means 114, while a value 0 (zero) is set as the set value of the calculating means 116 for the forward slip. The preparation for the rolling is that completed.

Subsequently, the rolling mill 10 is started and the encoder 113 deliver the pulse signals corresponding to the rotation speed of the roll 5*a*. The catching of the leading end of the work 1 by the rolls 5*a*, 5*b* is detected by means of load cells or the like attached to the rolling mill 10. Preferably, the roll-gap calculation means 119 are set to promptly reduce the roll gap to the initial value, upon detect of the catching of the work 1 by the rolls 5*a*, 5*b*, i.e. upon receipt of the signals from the load cells or the like.

As the detecting roller 10 of the travelling amount measuring device is passed by the leading end of the work 1, the encoder 111 starts to deliver the pulse signal corresponding to the speed of movement of the work 1 and the control cycle by the controller is commenced at this moment.

Namely, the rolling length measuring section 120 calculates the rolling length a from the pulse signal coming from the encoder 111 and the pulse signal coming from the aforementioned encoder 113. Then, the roll-gap instruction section 130 calculates the instantaneous command roll gap and delivers the same to the servo means section 140. Needless to say, when the product to be obtained includes the repetition of the shape as shown in FIG. 23, the command roll gap is kept constant during rolling of the flat sections. The servo means section 140 in turn controls the roll adjusting mechanism 7 of the rolling mill 10, in accordance with the instructions given by the roll-gap instruction section.

As one cycle of the roll-gap adjustment is over, the roll-gap calculation means 119 turns to the calculation of the first equation and performs the calculation of the series of equations. As this operation is repetitionally performed, an elongated material having a plurality of tapered leaf blanks each having a shape as shown in FIG. 23 is obtained.

It is to be noted here that, in the controlling apparatus of the invention, the rolling length a is determined not by a mere integration of the outlet velocity u as obtained by the speed calculating means 112 at the roll outlet nor by an approximation by a mere accumulation, but on the basis of the travel distance S of the roll 5*a* rolling the work 1, employing a correction or compensation in accordance with the forward slip f, so that the rolling length is determined at a high precision.

Namely, when the detection of the rolling length relies solely upon the output from the work outlet speed calculated by the work outlet speed calculating means 112, the error is inevitably involved by the measured rolling length when a slip of skip of the detection roller has taken place.

However, according to the invention, no error is caused by such a slip or skip of the detection roller 10, as will be understood from the following description.

Assuming here that the calculated value of the work outlet speed u is temporarily reduced to zero due to a skip of the detection roller, the value of the forward slip fi=(cu−vi)/vi as calculated by the calculating means for the forward slip 116 become −1. As this rate of advancement fi (−1) is delivered to the rolling length calculating means 17, the compensation value ΣVifi Δt is temporarily lowered, although such a state can never take place theoretically so that the calculated value of the rolling length a is reduced correspondingly as compared with the actual rolling length. Since the theoretically conceivable minimum rate of advancement 0 (zero) is set as the set value in the calculation means 116 for the forward slip, the latter compares the calculated value (−1) with the set reference value (0) with each other and delivers the larger one (0) to the rolling length calculating means 117, as the rate of advancement fi.

Therefore, the compensation value $\Sigma vifi\ \Delta t$ which is calculated in the rolling length calculating means 117 in accordance with the value of fi is never reduced, although its increment is temporarily stopped. In consequence, the influence of the skip of the detection roller 10 on the calculation of the rolling length a is diminished to ensure a higher precision of measurement of the rolling length.

In the foregoing description, an assumption has been made that the detection roller is temporarily stopped to rotate for a simplification of the explanation. However, so far as the relation $ui < vi$ exists, the calculated rate of advancement fi takes a negative value, so that the influence of the skipping of the detection roller is reduced even by a rather rough measure of setting the reference value in the calculating means 116 at 0 (zero).

In addition, if the reference value in the calculation means 116 is set as a value which changes continuously and which will not exceed the maximum possible value of the actual forward slip as stated before, it is possible to eliminate the influence of comparatively small slip, so that the measurement of the rolling length is rendered further accurate.

As has been described, according to the invention, there is provided a rolling control device having a rolling length measuring section capable of measuring at a high precision the rolling length which is quite an important factor in the rolling of an elongated material. Therefore, according to the invention, the control precision of the rolling mill is remarkably improved to permit the production of elongated materials having lengthwise thickness variation, at a high precision.

What is claimed is:

1. A method of producing a plate material having a uniform width and lengthwise thickness variation by imparting plastic deformations to a work by means of widthwise rolling and thicknesswise rolling rolls comprising the steps of: measuring the travelling amount of said work at the outlet of said widthwise rolling roll and at the outlet of said thicknesswise rolling rolls; changing continuously the roll gap between said widthwise rolling rolls through controlling the position of at least one of said widthwise rolling rolls in accordance with the measured amount of said work and in accordance with a previously set dimension of product and rolling condition, so as to reduce the width of said work at such portions of the latter as will be laterally spread to increase the width by a subsequent rolling by said thicknesswise rolling rolls; and changing the roll gap between said thicknesswise rolling rolls through controlling the position of at least one of said thicknesswise rolling rolls in accordance with the measured travelling amount of said work and in accordance with a previously set dimension of product and rolling condition, thereby to change the thickness of the work.

2. A method of producing a plate material as claimed in claim 1, characterized by comprising the step of forming a plurality of the same or different lengthwise thickness variations successively on a common work.

3. A method of producing a plate material as claimed in claim 1, wherein, taking into consideration the dimension of the final product to be obtained and various factors rolling condition such as material of the work, rolling temperature, rolling speed, roll diameter and so forth, said predetermined condition for said widthwise rolling rolls is given as a width function representing the relation between said travelling amount and the width of said work for each lengthwise width variation pattern, while said predetermined condition for said thicknesswise rolling rolls in given as a thickness function representing the relation between said travelling amount and the thickness of said work for each lengthwise thickness variation pattern, whereby the lengthwise offset of the portion of said work where the width is changed in accordance with said width function and the portion of the same where the thickness is changed in accordance with said thickness function from each other is corrected in each cycle of operation for imparting said thickness variation to said work.

4. A method of producing a plate material as claimed in claim 1, comprising the steps of measuring the width and thickness of the cross-section of said work at the outlet side of said thicknesswise rolling rolls; correcting in accordance with the result of the measurement a width function representing the travelling amount of said work and the width of said work and also a thickness function representing the relationship between said travelling amount and thickness of said work; and controlling the roll gaps in both of widthwise rolling rolls and said thicknesswise rolling rolls through controlling the position of at least one of said widthwise rolling rolls and the position of at least one of said thicknesswise rolling rolls.

5. A method of producing a plate material as claimed in claim 1, characterized by comprising the steps of determining the roll-gap controlling functions by correcting the width function and the thickness function, both of which represent the lengthwise dimensional variations of the product, in taking such correction points into consideration as:

(a) compensation for removing the estimated dimentional errors of the product which errors are caused by the changes in the roll deflections in widthwise rolling rolls and in said thickness wise rolling rolls due to changes in draft; and (b) compensation for removing the estimated dimensional errors of the product which errors are caused by the changes in position of points on said rolls where said rolls leave said work, in said widthwise rolling rolls and thicknesswise rolling rolls, said changes in position of said points being attributed to the change in inclination of the surface on the work, and (c) effecting a rolling while controlling the roll gaps in said widthwise rolling rolls and said thicknesswise rolling rolls in accordance with said roll-gap controlling functions.

6. A method of producing a plate material as claimed in claim 1, wherein, after imparting said lengthwise thickness variation to said work, said work is shorn during its movement into separate products of a unit length.

7. A method of producing a plate material as claimed in claim 1, comprising the steps of effecting a marking on said work after imparting to the latter said lengthwise thickness variation, and shearing said work at the marked positions into separate products of a unit length.

8. An apparatus for producing a plate material having a uniform width and a lengthwise thickness variation, characterized by comprising a pair of widthwise rolling rolls disposed at the upstream side of the flow of a work; a pair of thicknesswise rolling rolls disposed at the downstream side; roll adjusting mechanisms for changing the roll gaps between two rolls in each pair of said rolls by controlling the position of at least one of two rolls of each pair; devices for measuring the travelling amount of a work which devices are disposed at the outlet sides of said widthwise and thicknesswise rolling rolls, respectively; a controller adapted to calculate at least one of command roll positions and/or the command roll gap for each of said widthwise rolling rolls and said thicknesswise rolling rolls from the travelling amounts and predetermined conditions, and to deliver the results of calculations as electric output signals; means for measuring the roll positoin and/or roll gaps adapted to measure the position of at least one of two rolls of respective pairs, and/or each roll gap between two rolls of respective pairs; and servo means adapted to compare the actual roll positions and/or roll gap as measured by said means for measuring the roll positions and/or each roll gap with said command roll positions and/or said command roll gaps, and to actuate said roll adjusting mechanisms to control the positions of the roll and/or each roll gap regarding said widthwise rolling rolls and thicknesswise rolling rolls so as to nullify the difference between the actually measured values and the command values.

9. An apparatus for producing a plate material having a uniform width and a lengthwise thickness variation, characterized by comprising a pair of widthwise rolling rolls disposed at the upstream side of the flow of a work; a pair of thicknesswise rolling rolls disposed at the downstream side of said flow; roll adjusting mechanism for each pair of said rolls and adapted to change the positions of both rolls; travelling amount measuring device disposed at the outlet sides of said widthwise rolling rolls and said thicknesswise rolling rolls, respectively; a controller adapted to calculate the command position of each of said widthwise rolling rolls and the command position of each of said thicknesswise rolling rolls in accordance with the travelling amounts as measured by said travelling amount measuring devices and in accordance with predetermined conditions, and to deliver the result as electric signals; roll position sensing devices adapted to sense the distance between predetermined reference lines and each roll of respective pairs of rolls; and servo means adapted to compare the actual roll positions as sensed by said sensing devices with said command roll positions as derived from said controller and to actuate said roll adjusting mechanisms to control the position of each roll of said widthwise rolling rolls and the position of each roll of said thicknesswise rolling rolls so as to nullify the differences between the actual roll positions and the command roll positions.

10. An apparatus for producing a plate material as claimed in claim 8, characterized by comprising rolling load measuring means for measuring the rolling loads on said widthwise and thicknesswise rolling rolls, wherein the instruction given by said controller is corrected in accordance with said rolling load and the roll gap, whereby at least one roll position and/or roll gap of said widthwise rolling rolls and said thicknesswise rolling rolls is maintained at a predetermined value.

11. An apparatus for producing a plate material as claimed in claim 8, characterized by comprising a roll deflection compensation means provided between said controller and said servo means, wherein said roll deflection compensation means being adapted to perform a calculation for approximating by at least one linear equation the relationship between the roll deflection and the draft for each of said widthwise and thicknesswise rolling rolls, so as to preestimate the roll deflection in each pair of rolls, and to add the estimated roll deflection to each of instructions given by said controller, the resultant values are delivered to respective servo means to enable said rolls of respective pairs to perform the rolling while compensating for the roll deflections.

12. An apparatus for producing a plate material having a lengthwise thickness variation comprising:

a pair of widthwise rolling rolls disposed at the upstream side of a flow of a work;

a pair of thicknesswise rolling rolls disposed at the downstream side of said flow;

roll adjusting mechanisms adapted to change the roll gaps in each pair of rolls through controlling the position of at least one of each pair of rolls;

devices for measuring the travelling amount of work which devices are disposed at the outlet sides of said widthwise rolling rolls and said thicknesswise rolling rolls, respectively;

roll position and/or roll gap measuring means adapted to measure the position of at least one roll position and/or roll gap in each pair of rolls;

a main controller adapted to calculate at least one of the command roll positions and roll gas of each of said widthwise rolling roll and thicknesswise rolling rolls in accordance with the travelling amounts of said work as measured by said travelling amount measuring devices and in accordance with predetermined conditions, and to deliver the calculated values to respective servo means, said main controller being further adapted to produce, at the same time as said signal delivery to said servo means, a shearing position shaping signal which instructs to shape the portions of said work to be shorn;

servo means adapted to compare at least one of the actual roll positions and/or roll gap as measured by said roll position and/or roll gap measuring means with at least one of the command roll positions and/or roll gap as given by said controller, for each of said widthwise and thicknesswise rolling rolls, and to actuate said roll adjusting mechanisms to control at least one of the roll positions and/or roll gap for each of said widthwise and thicknesswise rolling rolls;

a shearing device disposed at the downstream side of said thicknesswise rolling rolls and having a shearing blade which is adapted to shear said work while being moved by a driving means at the same speed as said work;

a shearing blade position detecting means adapted to detect the instant position of said shearing blade; and a shearing device controlling means adapted to control said driving means for said shearing blade, in accordance with the result of detection of travelling amount of said work as measured by said travelling amount measuring device after the delivery of said shearing position shaping signal and the result of detection of position of said shearing blade made by said shearing blade position detection means, such that, when the portion of said work to be shorn passes said shearing device, said shearing blade shears said portion of said work while moving at the same speed as said work.

13. An apparatus for producing a plate material as claimed in claim 12, wherein one of said travelling amount measuring devices is located at the outlet side of said thicknesswise rolling rolls while another travelling amount measuring device is disposed at the downstream side of said shearing device.

14. An apparatus for producing a plate material having a lengthwise thickness variation comprising:

a pair of widthwise rolling rolls disposed at the upstream side of a flow of a work;

a pair of thicknesswise rolling roll disposed at the downstream side of said flow of said work;

roll adjusting mechanisms adapted to change the roll at least one of rolls of each pair;

devices for measuring the travelling amount of said work which devices are disposed at the outlet sides of said widthwise rolling rolls and said thicknesswise rolling rolls, respectively;

roll position and/or roll gap measuring means adapted to measure the position of at least one of rolls and/or the gap between rolls of each pair;

a main controller adapted to calculate at least one of the command roll positions and/or roll gap for each of said widthwise and thicknesswise rolling rolls from the travelling amounts of the work as measured by said travelling amount measuring devices and from predetermined conditions, said main controller being adapted to deliver the results of the calculation to the roll adjusting mechanisms of the production apparatus and, at the same time, to deliver a shearing position shaping signal which instructs to shape the portion of said work to be shorn;

servo means adapted to compare at least one of the roll positions and/or roll gap as measured by said roll position and/or roll gap measuring means with at least one of the command roll positions and/or roll gap as instructed by said main controller and to actuate said roll adjusting mechanisms to control at least one of the roll positoins and/or roll gap of each pair of said roll so as to nullify the differences between the command values and the actually measured values for respective pairs of rolls;

a marking device disposed at the downstream side of said thicknesswise rolling rolls and adapted to provide marks on said work;

a marking device control means adapted the operation of said marking device in accordance with the result of detection of travelling amount of said work made by said travelling amount measuring device, such that, when the portion to be shorn of said work passes said marking device, the marking tool of said marking device provides a mark on said portion of said work;

a reading device adapted to read the mark provided on said work; and a shearing device adapted to shear said work at portion to be shorn in accordance with the signal from said reading device.

15. An apparatus for producing a plate material as claimed in claim 14, wherein one of said travelling amount measuring device is located at the outlet side of said thicknesswise rolling rolls and another travelling amount measuring device is located at the downstream side of said marking device.

16. An apparatus for producing a plate material having a lengthwise thickness variation comprising:

a calculating means for pre-treatment which is adapted to determine, from the desired shape of the product and also from various factors of the rolling condition such as the material of the work, rolling temperature, rolling speed, roll diameters of widthwise rolling rolls and thicknesswise rolling rolls, (a) a width function which represents the reduction of width in relation to the length of said work, said width function being so determined as to reduce the width of said work at portions thereof where the width will be increased as a result of a subsequent thicknesswise rolling so that, after said thicknesswise rolling, a uniform width may be obtained over the length of said work, and (b) a compensated thickness function which is obtained by correcting a thickness function representing the final shape of the product to eliminate the offset by the dimension from the designated dimension which is expected to be caused, when said thicknesswise rolling is effected in accordance with said thickness function, by at least one of change in the roll diameter and change in the roll deflection;

a pair of widthwise rolling rolls disposed at the upstream side of flow of said work;

a pair of thicknesswise rolling rolls disposed at the downstream side of said flow;

roll adjusting mechanisms adapted to change the roll gap in each of said widthwise rolling rolls and said thicknesswise rolling rolls by controlling the position of at least one of rolls of each pair;

a travelling amount measuring device for width control disposed at the outlet side of said widthwise rolling rolls and adapted to measure the travelling amount of said work;

a calculating means for width control adapted to calculate at least one of the instant command roll positions and/or roll gap of said widthwise rolling rolls, in accordance with the output from said travelling amount measuring device for width control and said width function delivered by said calculating means for pre-treatment;

servo means for width control having a roll position and/or gap measuring device adapted to measure at least one of the roll positions and/or roll gap of said widthwise rolling rolls, said servo means being adapted to control said roll adjusting mechanism for width control such that the output from said roll gap measuring device coincides with the output from said calculating means for width control;

a device for measuring the travelling amount of work for thickness control which device is disposed at the outlet side of said thicknesswise rolling rolls;

calculating means for thickness control adapted to calculate at least one of the instant command roll positions and/or roll gap of said thicknesswise rolling rolls, in accordance with the output from said travelling amount measuring device for width control, the output from said travelling amount measuring device for thickness control and in accordance with said compensated thickness function as delivered by said calculating means for pre-treatment; and servo means having a roll gap measuring device adapted for measuring at least the roll position and/or roll gap of said thicknesswise rolling rolls and adapted to said roll adjusting mechanism for thickness control so as to make the output from said roll position and/or roll gap measuring device coincide with the output from said calculating means for thickness control.

17. An apparatus for producing a plate material as claimed in claim 8, wherein said travelling amount measuring devices include detection rollers adapted to be brought into contact with the work surfaces at the outlet sides of said widthwise and thicknesswise rolling rolls, and pulse generators adapted to produce pulse signals in accordance with the rotations of said detection rollers.

18. An apparatus for producing a plate material as claimed in claim 8, wherein said travelling amount measuring device includes:

first pulse generators adapted to detect the rotation speeds of said widthwise and thicknesswise rolling rolls;

detection rollers put in contact with the surface of said work at the outlet sides of respective pairs of rolls;

second pulse generators adapted to detect the rotation speeds of said detection rollers;

calculation means for the forward slip adapted to make a calculation of $(u-v)/v$ in accordance with the outputs from said first and second pulse generators, where u and v representing, respectively, the moving speed of said work and the peripheral speed of said rolls, said calculation means for the forward slip being further adapted to compare the resulted value of calculation with a reference value and to deliver the larger one of said calculated value and said reference value as the forward slip f, and travelling amount calculation means adapted to make a calculation of $S=\int V\,dt$ in accordance with the output from said means for calculating the peripheral speeds of said rolls so as to calculate the travel distance of roll surfaces and to effect on the calculated travel distance a correction in accordance with the output from said calculating means for forward slip by the equation $a=S+\int V\,f\,dt$ to work out the travelling amount of said work.

19. An apparatus for producing a plate material as claimed in claim 8, characterized by further comprising a section measuring device adapted to measure at least the thickness and/or width of the section of said work at the outlet side of said thicknesswise rolling roll, and to feed the result of the measurement back to said controller; said controller being adapted to correct at least one of the roll positions and/or roll gaps of said widthwise and thicknesswise rolling rolls so as to reduce the difference between the measured size of said section and the command size of said section of said work.

20. An apparatus for producing a plate material as claimed in claim 16, wherein said controller is adapted to produce, at the same time as said signal delivery to said servo means, a shearing position shaping signal which instructs to shape the portions of said work to be shorn, said apparatus comprising, a shearing device disposed at the downstream side of said thicknesswise rolling roll and having a shearing blade which is adapted to be driven by a driving means to shear said work while moving in the same direction as said work;

a shearing blade position detecting means for detecting the instant position of said shearing blade; and a shearing device control means adapted to control said driving means for said shearing blade in accordance with the result of the measurement of travelling amount of said work made by said travelling amount measuring means after the delivery of said shearing position shaping signal by said controller and in accordance with the result of detection of position of said shearing blade made by a shearing blade position detecting means, such that, when the portion to be shorn of said work passes said shearing device, said shearing blade shears said portion of said work while moving at the same speed as said work.

21. An apparatus for producing a plate material as claimed in claim 16, wherein said controller is adapted to produce, at the same time as said signal delivery to said servo means, a shearing position shaping signal which instructs to shape the portion of said work to be shorn, said apparatus comprising, a marking device disposed at the downstream side of said thicknesswise rolling rolls are provided with a marking tool for providing a mark on said work;

a marking device control means adapted to control the operation of said marking device in accordance with the result of measurement of said travelling amount of said work made by said travelling amount measuring device such that, when the portion to be shorn of said wrok passes said marking device, said marking tool of said marking device puts a mark on said portion of said work;

a reading device adapted to read the mark put on said work; and a shearing device adapted to shear said portion to be shorn of said work in accordance with the reading output from said reading device.

* * * * *